United States Patent [19]

Davison et al.

[11] Patent Number: 4,928,240

[45] Date of Patent: May 22, 1990

[54] ACTIVE CLEARANCE CONTROL

[75] Inventors: Samuel H. Davison, Loveland; Kevin H. Kast, Cincinnati; Aidan W. Clark, Blue Ash, all of Ohio

[73] Assignee: General Electric Company, Cincinnati, Ohio

[21] Appl. No.: 160,052

[22] Filed: Feb. 24, 1988

[51] Int. Cl.[5] ..... F01D 11/00

[52] U.S. Cl. ..... 364/431.02; 60/39.75; 415/116; 415/178

[58] Field of Search ..... 60/39.29, 39.75; 415/178, 115, 116, 175, 176; 364/431.03, 431.01, 431.02; 73/660

[56] References Cited

U.S. PATENT DOCUMENTS

| | | | |
|---|---|---|---|
| 3,039,737 | 6/1962 | Kolthoff, Jr. | 415/17 |
| 3,085,398 | 4/1963 | Ingleson | 60/39.32 |
| 4,023,919 | 5/1977 | Patterson | 415/178 X |
| 4,127,357 | 11/1978 | Patterson | 415/116 |
| 4,230,436 | 10/1980 | Davison | 415/1 |
| 4,230,439 | 10/1980 | Smith, Jr. et al. | 415/138 |
| 4,247,247 | 1/1981 | Thebert | 415/171 X |
| 4,304,093 | 12/1981 | Schulze | 60/39.07 |
| 4,329,114 | 5/1982 | Johnston et al. | 60/39.29 X |
| 4,338,061 | 7/1982 | Beitler et al. | 415/175 X |
| 4,471,938 | 9/1984 | Schwarz | 91/402 X |
| 4,756,152 | 7/1988 | Krukoski et al. | 60/39.29 X |

*Primary Examiner*—Eugene R. LaRoche
*Assistant Examiner*—Seung Ham
*Attorney, Agent, or Firm*—Jerome C. Squillaro; Nathan D. Herkamp

[57] ABSTRACT

The invention relates to a control system which controls the diameter of a turbine shroud which surrounds a turbine in a gas turbine aircraft engine. The invention seeks to minimize the clearance between the turbine rotor and the shroud. Air is bled from the compressor in the engine and ducted to the shroud in order to heat or cool the shroud in order to, respectively, either expand or shrink the shroud to a proper diameter. The air temperature which is required is computed based on compressor speed and other engine parameters, but not upon directly measured rotor temperature, despite the fact that rotor temperature has a significant influence upon rotor diameter, and thus upon shroud diameter needed. Air at two different temperatures is bled from two different compressor stages in the engine and mixed together in a ratio which is determined according to flight conditions, in order to provide air of the required temperature for the shroud, and then ducted to the shroud in order to modify shroud size. Further, during accelerations and decelerations of the engine, a different air temperature is provided, as compared with that provided during steady state operation. In the event that the system just described should fail, back-up systems control shroud diameter. There exist two back-up systems, one for use during steady state, and the other for use during accelerations and decelerations.

47 Claims, 11 Drawing Sheets

ACTIVE CLEARANCE CONTROL

The invention relates to controlling the clearance between (1) the tips of turbine blades in a gas turbine engine and (2) the shroud which surrounds the turbine.

BACKGROUND OF THE INVENTION

FIG. 1 illustrates a twin spool, high bypass gas turbine aircraft engine. The first spool includes a shaft 3 which carries a fan 6, a booster compressor 9, and a low-pressure turbine 12. A second spool includes a shaft 15 which carries a high-pressure compressor 18 and a high-pressure turbine 21. In operation, an incoming airstream 24 is compressed by booster 9, further compressed by high-pressure compressor 18, and delivered to a combustor 27. Therein, fuel is injected, the mixture burns, expands, and exhausts in sequence through the high-pressure turbine 21 and the low-pressure turbine 12, providing energy to rotate the turbines, the compressors, and the fan 6. The fan generates a propulsive airstream 30.

The clearance, represented by dimension 33, between the high-pressure turbine 21 and a shroud 36 which surrounds it, must be maintained as small as possible in order to prevent leakage of air through the clearance 33. Leaking air imparts little or no momentum to the turbine, and thus represents a loss in energy. One possible solution to the leakage problem may be thought to lie in the expedient of manufacturing the engine such that the clearance 33 is a small dimension, such as 1/1000th of an inch. However, this approach is not feasible, as FIG. 2 will illustrate. In that figure, the turbine blades and the shroud are shown in two states, namely, their cold, unexpanded state, labeled by numerals 40 and 42, and their hot, expanded state, drawn in phantom and indicated by numerals 44 and 46.

The expansion of the turbine rotor can be viewed as resulting from the combined effects of three factors: (1) centrifugal expansion of the turbine rotor disc occurring from ground idle to takeoff, which is indicated by numeral 123 in FIG. 1, and which can amount to an increase in radius of the turbine blades (dimension 49A in FIG. 2) of about 0.020 inches; (2) thermal expansion of turbine rotor disc 123 in FIG. 1, which is approximately equal to the 0.065 inch centrifugal expansion; and (3) thermal expansion of the blades themselves, which increases the dimension 49A in FIG. 2 by about 0.005 inch.

At about the same time that the tip radius 49A in FIG. 2 is changing, the hot gas stream passing through the turbine blades causes the shroud 44 to expand to phantom position 46. In particular, during an acceleration from ground idle to a speed of 14,500 rpm in the high pressure turbine 21 in FIG. 1, the events just described occur in generally the following sequence: (1) centrifugal expansion of the rotor disc, which is immediate, followed by (2) blade thermal expansion, followed by (3) shroud thermal expansion, and, finally, (4) rotor disc thermal expansion.

Although this sequence is oversimplified, since the actual cooperation of the four factors is more complex than just described, the following principle is clear. Given the dimensional changes assumed, the clearance 33, when the components are non-rotating, must exceed 0.025 inches, because the centrifugal expansion of the disc (0.020 inch), together with the thermal expansion of the blades 40 (0.005 inch), will consume this clearance, before the thermal expansion of the shroud 42 will move the shroud out of the way. However, this clearance of 0.025 inches allows leakage losses at the blade tips which are preferably avoided.

Further, the thermal expansion of the shroud 42 from the solid position shown to the phantom position 46 is about the same as the thermal expansion of the rotor disc, which is about 0.020 inches, as stated above. However, as also stated, the shroud thermal expansion precedes disc thermal expansion by 10 to 30 minutes, depending on rotor rpm. Therefore, during this period, an unwanted clearance of up to 0.020 inches can exist.

OBJECT OF THE INVENTION

It is an object of the present invention to provide a new and improved active clearance control for gas turbine engines.

SUMMARY OF THE INVENTION

In one form of the invention, diameter of a turbine rotor is inferred from turbine speed. Based on this inferred diameter, hot and cold air are blown upon the shroud surrounding the turbine in order to expand or shrink the shroud as appropriate in order to maintain the distance between the turbine and the shroud at a proper level.

DETAILED DESCRIPTION OF THE INVENTION

The following discussion will give (1) a very generalized overview of the invention, (2) a description of equipment used by the invention, (3) an overview of the control system, followed by (4) a detailed description of the control system.

Overview

Figure 4:
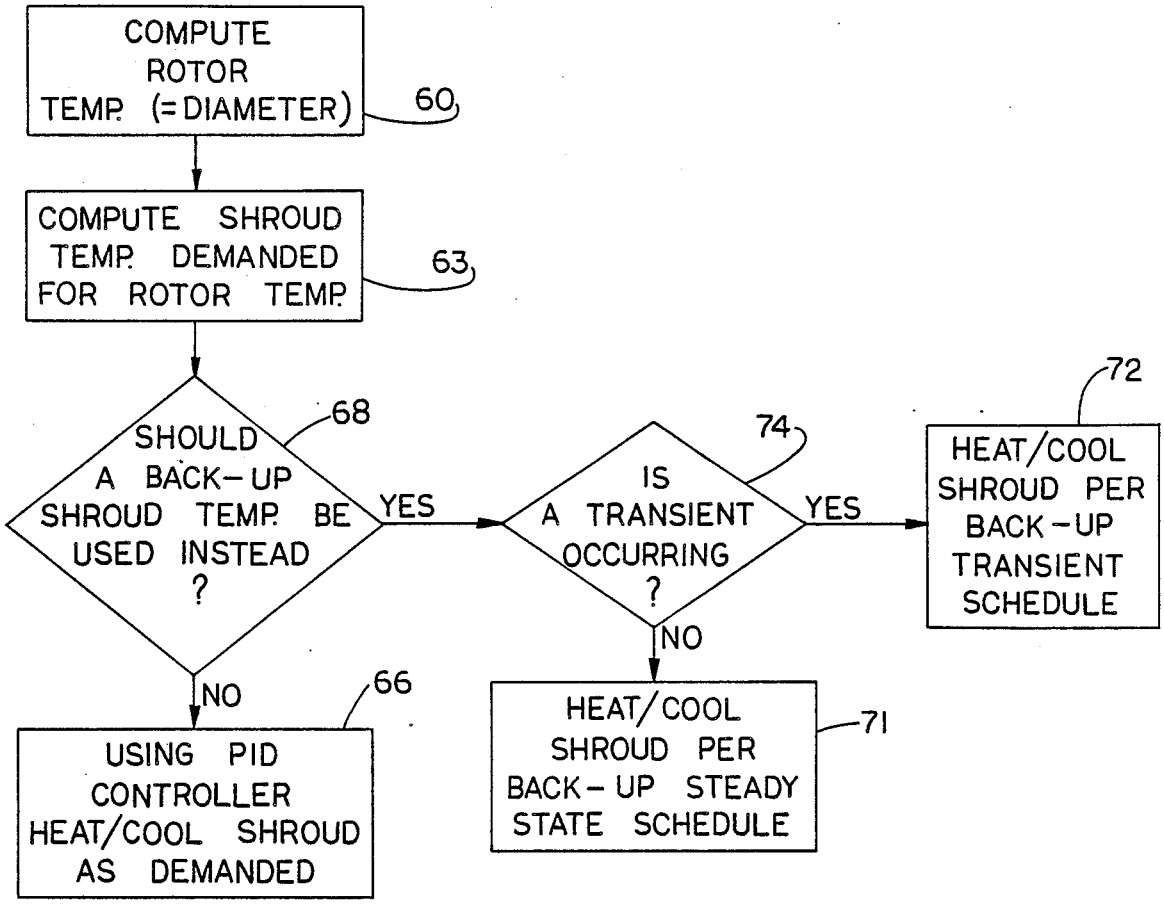
FIG. 4 illustrates an overview of the invention.

A generalized overview of the invention is given in FIG. 4. Block 60 computes the temperature of the turbine rotor, based on rotational speed of the rotor. Then, block 63 calculates the proper shroud temperature for this rotor temperature. The inventors point out that no diameters are calculated: rotor temperature allows one to calculate rotor diameter. Rotor diameter determines shroud diameter, which determines the shroud temperature needed. Thus, the necessary shroud temperature can be obtained directly from rotor temperature.

In order to bring the shroud to the demanded temperature, a Proportional Integral Derivative (PID) controller, indicated in block 66, controls by using a valve, two sources of air (not shown), in order to drive the shroud to the proper temperature. The two sources of air are obtained from two different compressor stages of the engine.

Because the equipment represented by blocks 60 and 63 can fail, back-up systems represented by blocks 71, 72 and 74 are provided. These latter blocks compute back-up demanded valve positions based on rotor temperature. Block 68 decides whether the back-up system should be used. If so, block 74 inquires whether a transient is occurring. If so, block 72 provides a back-up valve demanded position which is proper during a transient. If no transient is occurring, block 71 provides a back-up demanded valve position which is proper for steady-state operation.

The back-up demanded valve positions are computed based on factors such as (1) whether the engine is undergoing an acceleration or a deceleration (i.e., undergoing a transient) or operating at steady-state; (2) if a transient is occurring, the intensity of the transient; (3) whether temperature sensors, which indicate shroud temperature, have failed; (4) whether a condition, later described, known as "hot rotor reburst" is about to occur; and (5) whether the aircraft is undergoing a takeoff maneuver. This discussion will now turn to a more detailed description of equipment used in the invention, starting with a description of hardware which controls shroud temperature.

Equipment

Figure 1:
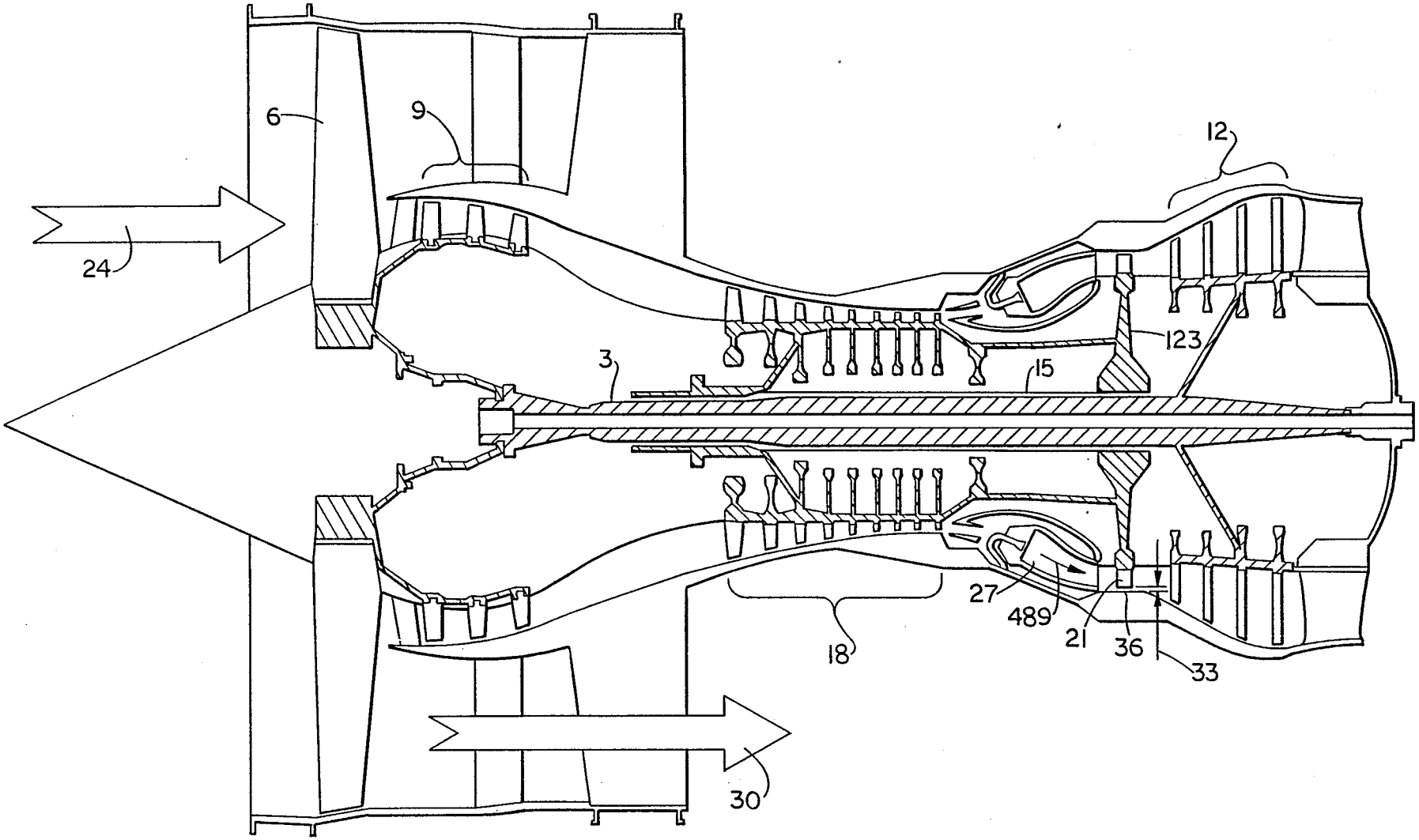
FIG. 1 illustrates a gas turbine engine in cross-section.
Figure 1A:
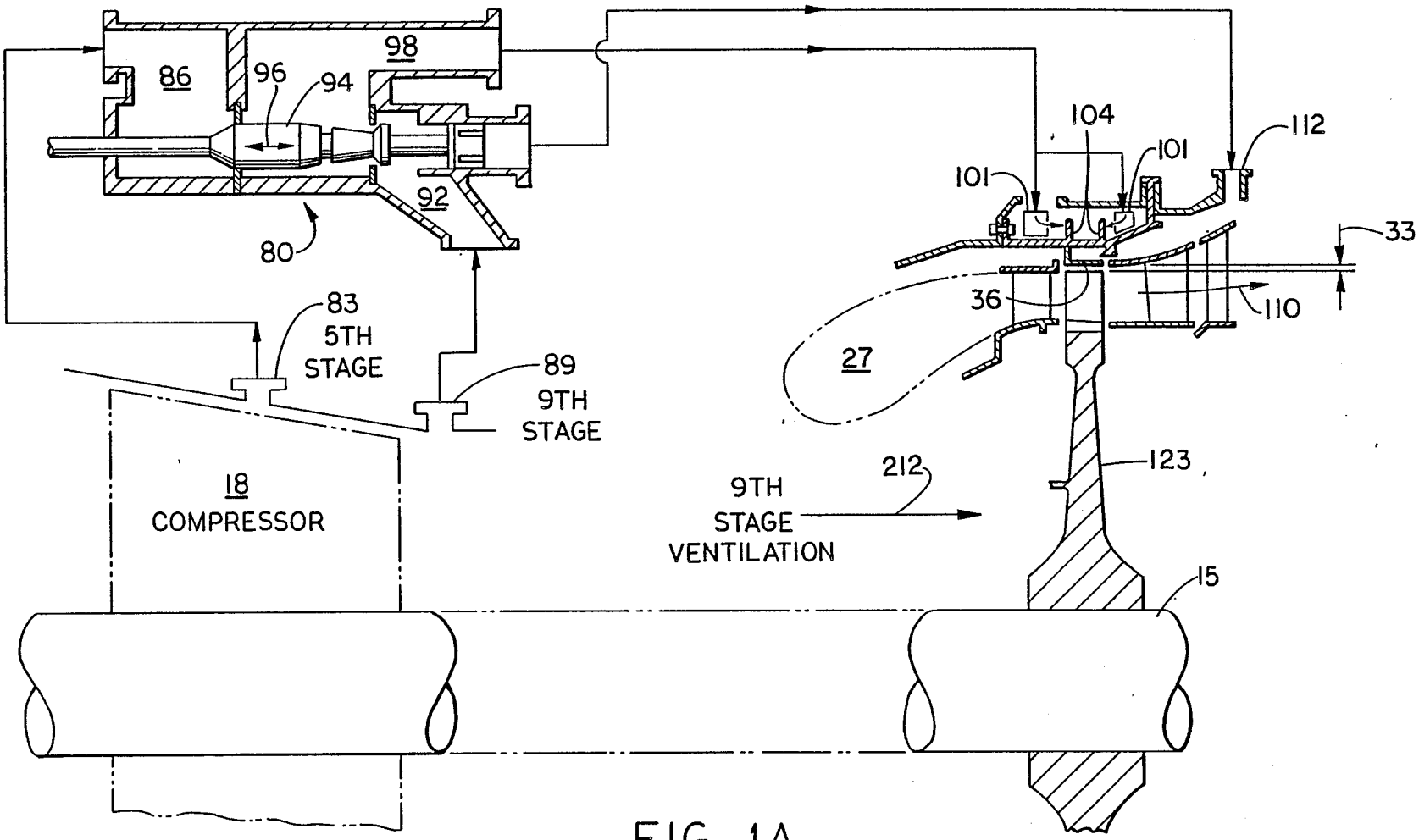
FIG. 1A illustrates selected components of FIG. 1.
Figure 2:
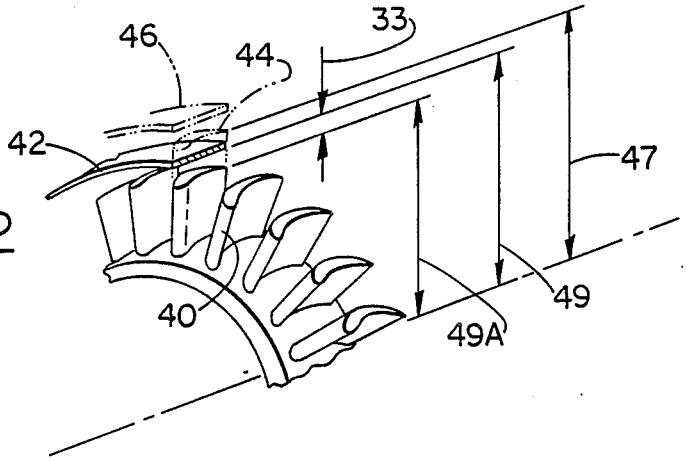
FIG. 2 illustrates clearance in a turbine.

FIG. 1A is a simplification of FIG. 1, and shows, in addition, a valve 80 which controls the hot and cold air described above. A fifth stage compressor bleed, taken at point 83 in FIG. 1A, supplies air at approximately 700° F. and 150 psia (pounds per square inch absolute) to a first chamber 86 of the valve 80. A ninth stage bleed, taken from point 89, supplies air at approximately 980° F. and 380 psia to a second chamber 92 in the valve. The valve poppet 94 can move leftward and rightward as indicated by arrow 96. The position of the valve poppet 94 determines the relative percentages of fifth stage and ninth stage bleeds delivered to an output chamber 98 for mixing 98. (Further explanation of this mixing is given below, in connection with FIG. 3.)

The output chamber 98 is connected to manifolds 101 which surround rings 104 which support the shroud 36. As indicated by arrows 109, the air delivered to the manifolds 101 is blown upon the rings 104, thereby altering the temperature of the rings, thereby expanding or contracting the rings, in order to change the diameter of the shroud 36 to the diameter which is proper for the prevailing turbine diameter.

The valve 80 in FIG. 1A also has a bleed feature, further explained below, which bleeds ninth stage compressor air into the turbine exhaust 110 just downstream of the turbine as indicated by arrow 112. This type of bleed serves to maintain stall margin during engine starting, as known in the art.

Figure 3A:
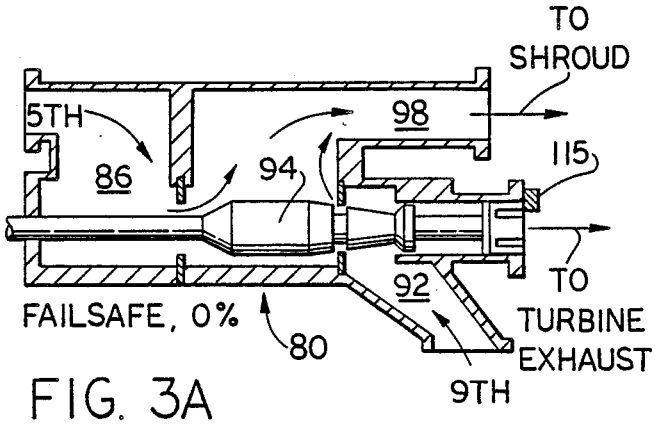
FIGS. 3A–3F illustrate six different positions of a valve poppet 94.

FIGS. 3A–3F illustrate the relative fractions of fifth stage and ninth stage air which can be attained in output chamber 92, depending upon the position of the valve poppet 94. The position of the valve poppet is given in terms of percentages. The percentages refer to the actual linear displacement of the poppet from its rightmost position, but expressed as a percentage of the displacement when in the leftmost position. As an example, when the poppet is in the full rightmost position, the displacement is 0%, as indicated in FIG. 3A. If the poppet were fully in the leftmost position as in FIG. 3F, the displacement would be 100%. If the poppet were half way between left and right positions, the displacement would be 50%.

As shown in FIG. 3A, at 0% displacement, both fifth stage and ninth stage air are supplied to the shroud 36. The respective areas of the fifth stage annulus 117A and the ninth stage annulus 117, at various percentage positions are given in the following Table 1. "LPT" in Table 1 refers to the Low Pressure Turbine 12 in FIG. 1, and the numbers in the LPT column refer to the cross-sectional area of the passage in FIG. 1A through which arrow 12 passes.

TABLE 1

| Displacement (%) | Effective Area (Sq. Inch) Fifth Stage | Ninth Stage | LPT |
|---|---|---|---|
| 0.0 | 0.84 | 0.162 | 0 |
| 2.5 | 0.84 | 0.162 | 0 |
| 5.5 | 0.84 | 0.0 | 0 |
| 9.5 | 0.84 | 0.0 | 0 |
| 22.5 | 0.84 | 0.0455 | 0 |
| 60.0 | 0.0 | 0.107 | 0 |
| 62.5 | 0.0 | 0.107 | 0 |
| 65.0 | 0.0 | 0.0 | 0 |
| 70.0 | 0.0 | 0.0 | 0 |
| 75.0 | 0.0 | 0.234 | 0 |
| 80.0 | 0.0 | 0.234 | 0 |
| 100.0 | 0.0 | 0.234 | 0.616 |

The 0% displacement in FIG. 3A is considered a fail-safe position, as indicated, because it provides significant heating (9th stage air is hotter than fifth stage air), and thus expansion, of the shroud. That is, in the case of equipment failure, it is desirable to maintain the shroud at a large diameter, and away from the turbine blades rather than at a small, or uncontrolled diameter. The heating provided by the 0% displacement accomplishes the expansion.

However, even though, as the discussion immediately following will show, a different position (the 81.5% position in FIG. 3E) provides a larger amount of hotter air to the shroud, nevertheless, the 0% position is used as the fail safe position. One reason is that a readily available actuator (not shown) such as a spring or hydraulic piston, can easily drive the poppet 94 against a seat 115 in order to attain the 0% position. On the other hand, in the 81.5% position, the poppet does not rest against such a seat, but "floats", and thus a more complex control system would be needed to maintain the poppet at the 81.5% position.

Figure 3B:
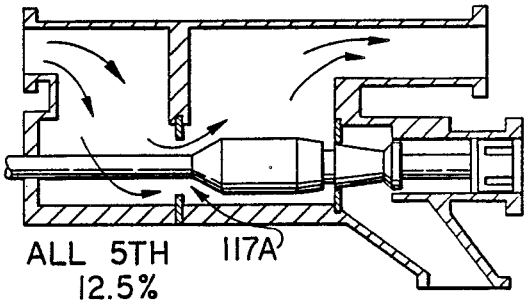

The position next to the 0% position is the 12.5% position, which delivers all fifth stage air, and no ninth stage air, to the shroud, as indicated in FIG. 3B.

Figure 3C:
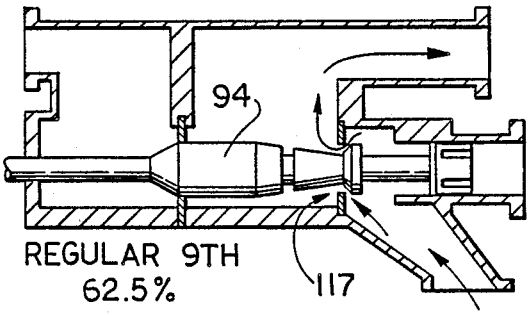

The next position is the 62.5% position in FIG. 3C, which is, in a sense, the converse of the 12.5% position, because at the 62.5% position, only ninth stage air is delivered to the shroud, as opposed to the case for the 12.5% position, wherein only fifth stage air is delivered. The poppet 94 can be modulated, by actuators known in the art, to occupy positions intermediate between the 12.5% position and the 62.5% position in order to adjust the relative percentages of fifth and ninth stage air delivered to the shroud. The range of 12.5% to 62.5% will be termed a modulation range. During operation in the modulation range, the temperature of the shroud is determined by the relative mass flows of fifth stage air, as compared with ninth stage air.

Figure 3D:
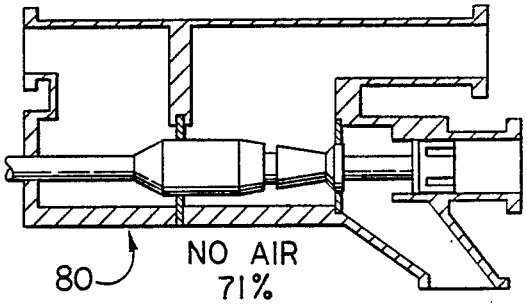

The 71% position, shown in FIG. 3D, blocks off all air from both the fifth and ninth stages. In the 71% position, no heating or cooling air is delivered to the shroud.

Figure 3E:
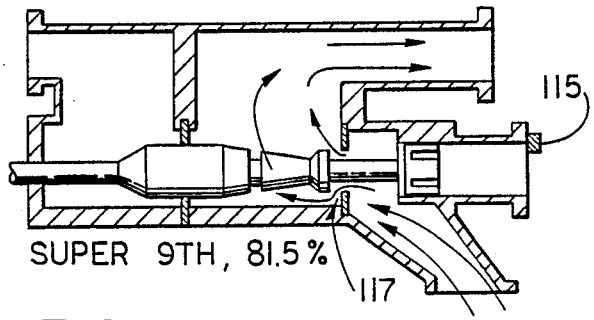
Figure 5:
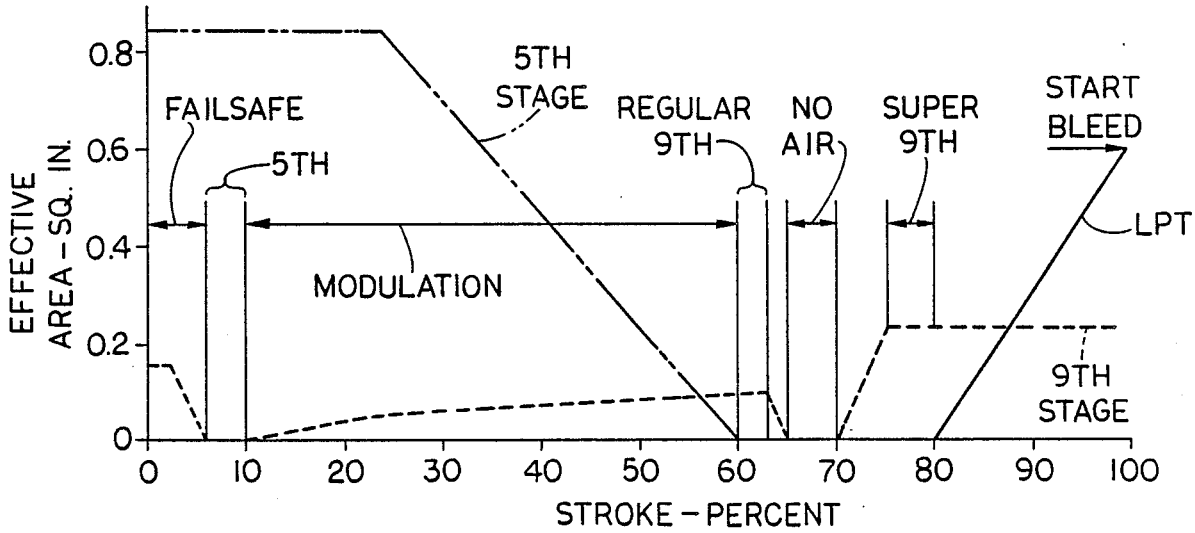
FIG. 5 illustrates percentage of valve aperture plotted versus valve poppet position.

The 81.5% position is illustrated in FIG. 3E. The 81.5% position is similar to the 62.5% position of FIG. 3C in the respect that both of them deliver exclusively ninth stage air to the shroud. However, as indicated in FIG. 5 and Table 1, the area of the ninth stage annulus 117 surrounding the poppet 94 in FIG. 3E is larger for the 81.5% case (0.234 square inches) as compared with the 62.5% case (0.107 square inches.) The 81.5% position is termed a "super ninth" position, and is used when very rapid expansion of the shroud is sought.

Figure 3F:
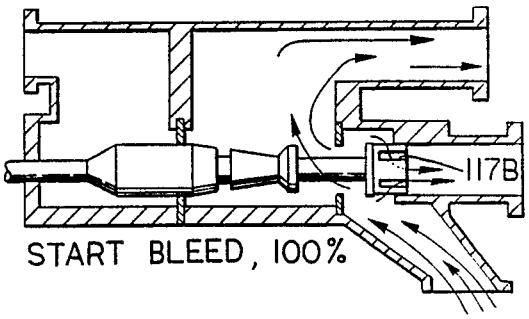

FIG. 3F illustrates the 100% position, in which ninth stage air is bled to both the shroud and to the low-pressure turbine, as mentioned above. The principle function of this type of bleeding is to reduce the tendency of the compressor to stall, as can occur during engine starting. Compressor bleeding for this purpose is known in the art. The cross-sectional area of 0.616 in Table 1 for the 100% displacement refers to the total area of holes 117A in FIG. 3F.

This discussion will now turn to the control system which computes the desired shroud temperature and, in response, adjusts the position of the valve poppet 94 in FIG. 1A in order to deliver air at the proper temperature and volume to the shroud.

Control System Overview

Figure 6:
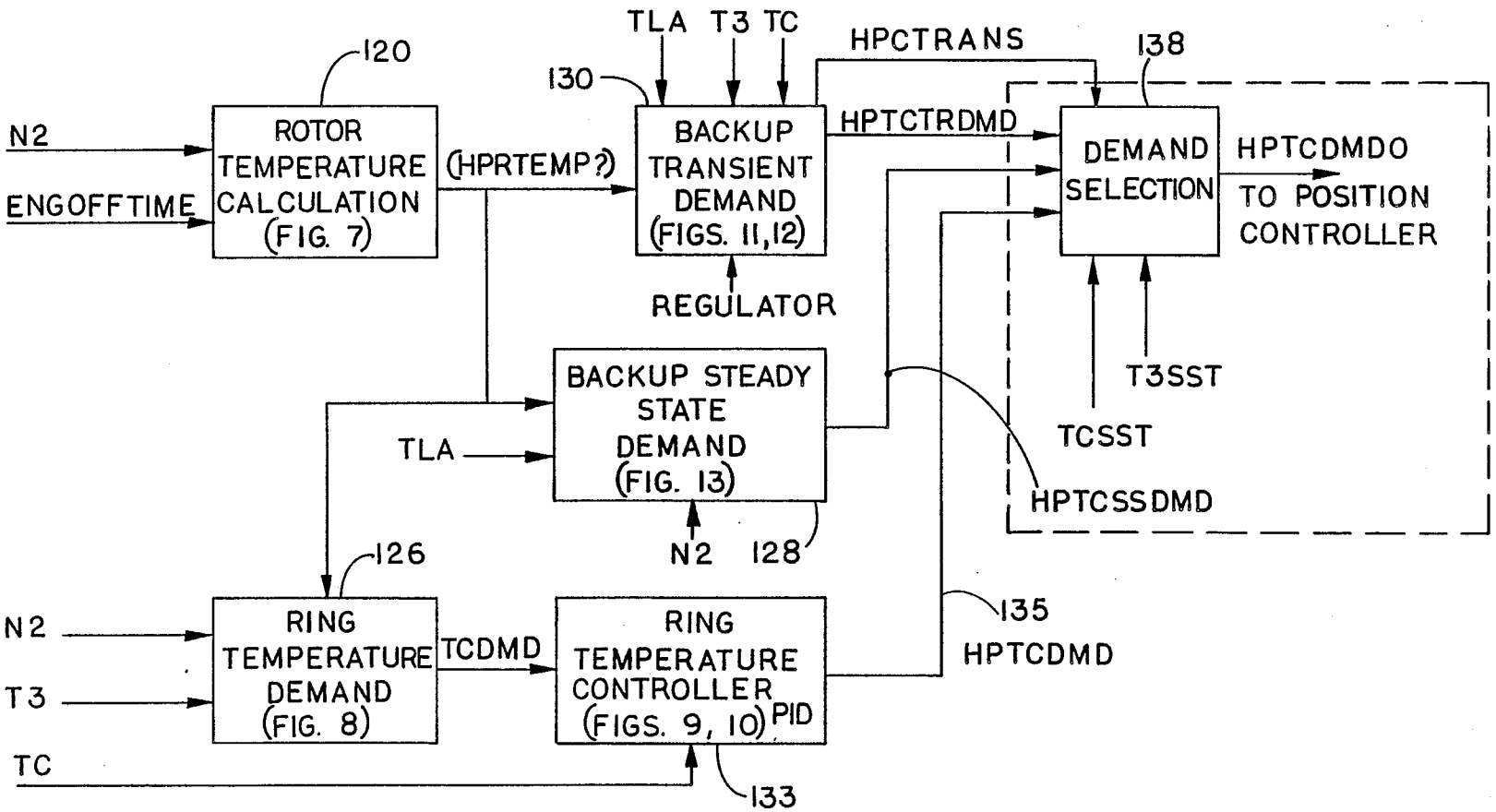
FIG. 6 illustrates a second overview of the invention.

FIG. 6 gives an overview of the control system. The individual blocks of FIG. 6 are shown in greater detail in figures to be later described. Block 120 receives as input N2, which is the rotational speed of both the high-pressure compressor 18 and the high-pressure turbine 21 in FIG. 1, and also receives ENGOFFTIME, which is an indicator of the length of time the engine has been running. Both N2 and ENGOFFTIME are derived by apparatus known in the art.

Based on N2 and ENGOFFTIME, block 120 computes the temperature of the turbine rotor 123 in FIGS. 1 and 1A. The computed rotor temperature is given the name HPRTEMP as indicated in FIG. 6. HPRTEMP is fed to three blocks, namely, blocks 126, 128 and 130. The first block 126 computes the demanded temperature (TCDMD) of the rings 104 in FIG. 1A. As stated above, ring temperature controls the diameter of shroud 36. Demanded ring temperature is computed based on three inputs to block 126 in FIG. 6: (1) the inferred rotor temperature, HPRTEMP, (2) rotor speed, N2, and (3) the temperature of the ninth stage bleed 89 in FIG. 1A, termed T3 in FIG. 6.

The demanded ring temperature, TCDMD, is fed to a ring temperature controller, indicated by block 133. Also fed to block 133 is the measured ring temperature, TC. The ring temperature controller provides a position signal on line 135 indicative of the percentage position to which poppet 94 in FIG. 1A should be driven in order to provide the correct amount and temperature of air to the shroud manifold 101. This position signal is fed to a demand selection block 138, which will now be discussed.

It is possible that the temperature sensors which produce temperatures T3 and TC, which are fed to blocks 126 and 133, may fail. If such a failure occurs, it may be impossible for these two blocks 126 and 133 to properly compute their respective outputs. In such a case, other blocks 128 and 130 compute back-up (fail-safe) demands. The demand selection block 138 selects one of the valve position demands, either the signal produced by the ring temperature controller 133, or one of the back-up signals produced by blocks 128 or 130, in response to other signals which indicate whether a failure has occurred. The demand selection block 138 then produces a signal, HPTCDMDO, based on the demanded signal selected, which is fed to a device known in the art (called a "position controller" in FIG. 6) which drives the valve poppet 94 in FIG. 1A to the desired position. The individual blocks in FIG. 6 will now be discussed in greater detail.

DETAILED DESCRIPTION OF CONTROL SYSTEM

Rotor Temperature Computation

Figure 7:
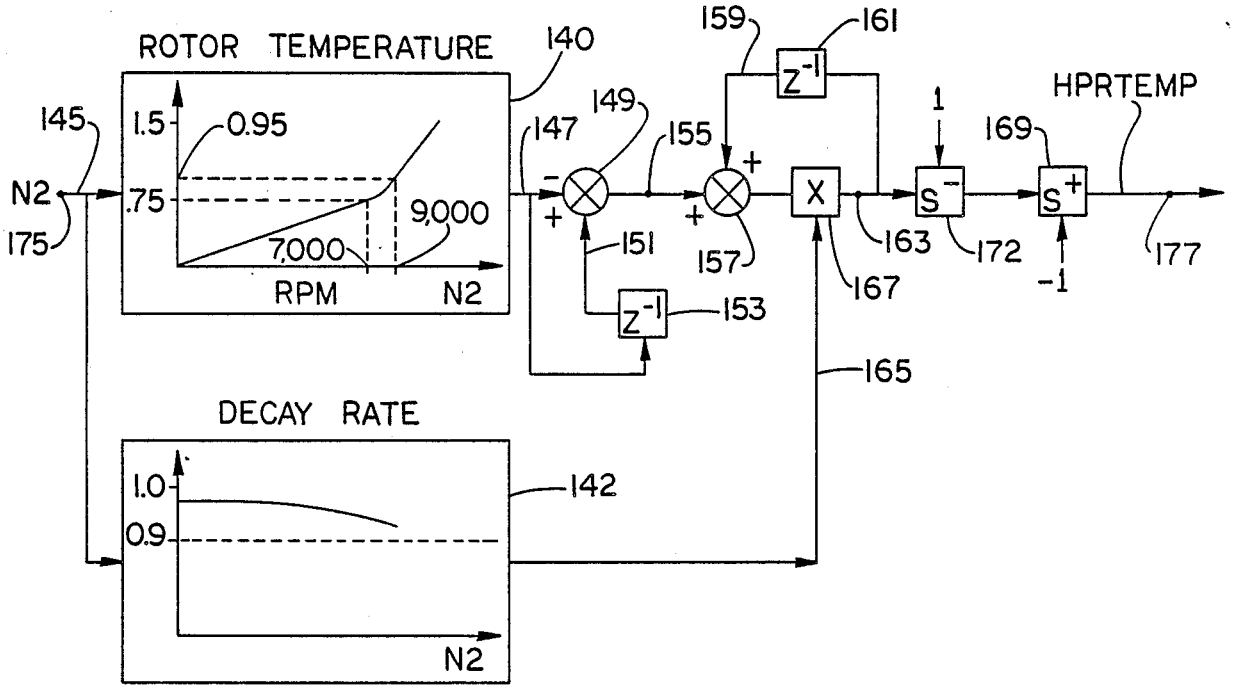
FIGS. 7–13 illustrate in greater detail the blocks of FIG. 6.

The rotor temperature calculation block 120 of FIG. 6 is shown in more detail in FIG. 7. The rotational speed of the high-pressure compressor N2 (i.e., core speed) feeds to both a rotor temperature schedule 140 and a decay rate schedule 142. The rotor temperature schedule 140 gives the rotor temperature which will be attained, at steady state, for any given core speed, N2. For example, a core speed of 7,000 rpm, as indicated, causes a steady-state rotor temperature of 0.75 to occur. (The vertical axis in the schedule 140 ranges from 0 to 1.5, and not in customary units of temperature, for reasons which will become clear later.)

The decay rate schedule 142 comes into use after core speed changes, and causes the computed rotor temperature to mimic the behavior of the actual rotor temperature. Examples given later will illustrate this mimicry.

The actual variable computed is HPRTEMP, as indicated, which ranges from negative 1 to plus 1, and which indicates the degree of stabilization of rotor temperature. Restated, HPRTEMP indicates how much actual rotor temperature deviates from the steady-state temperature contained in schedule 140. Further, HPRTEMP is derived from core speed, N2, and not from direct temperature measurement. An example will illustrate the functioning of FIG. 7.

Assume that N2 has stabilized at 7,000 rpm. Therefore, the signal on line 145 has a value indicating that N2 equals 7,000 rpm. Assume also that the stabilized rotor temperature in block 140 corresponding to 7,000 rpm is 0.75, as indicated. As a result, the input 147 to summer 149 is −0.75. The other input to summer 149, at the positive terminal 151, is positive +0.75. This is so because a "Z-block" 153, containing the symbol $Z^{-1}$, applies to positive input 151 the scheduled value existing at the last iteration of the computation represented in FIG. 7. [The reader is reminded that FIGS. 6 and 7 are block diagrams representing computer code. Consequently, for example, point 155 (discussed below) does not actually exist as a point in space. Point 155 represents the value of a variable computed at the relative time indicated.]

Accordingly, the output of summer 149 at point 155 is 0. This 0 output is fed to the positive terminal of summer 157, while the other input, also positive, on line 159, is also 0, as will now be explained. Again, Z-block 161 applies the last iterated value existing at point 163 to summer 157. Let it be assumed that the signal on line 165 indicates a decay rate of unity. Therefore, at steady state, the signal resulting at point 163 is continually 0. (Zero at point 155 is added to zero on line 159. The result is multiplied by one in multiplier 167 to yield zero at point 163.) Maximum selector 169 and minimum selector 172 limit excursions of this signal between −1 and +1 as indicated. (The symbol S+ means that the maximum signal of the two inputs is selected.) Therefore, HPRTEMP, produced by maximum selector 169, at steady state, has the value of 0 indicating that no deviation exists in actual rotor temperature from the steady-state temperature at the present rotor speed, N2.

Now an exaggerated, first example will be given which illustrates how HPRTEMP indicates deviation from thermal stabilization by rotor 123 in FIG. 1A. Assume that N2 instantly jumps from 7,000 rpm to 9,000 rpm. In this case, normalized rotor temperature in block 140 will jump from 0.75 to 0.95, as shown. Now, the negative input to summer 149 is −0.95. Z-block 153 adds to this the value 0.75, which was the last previous output scheduled value. Now, the output of summer 149 is −0.20. This, when added to the last previous value at point 163, as applied by Z-block 161 to summer 157 gives the value of −0.20 at point 163. (Again, it is assumed that the decay rate signal on line 165 is unity.) Therefore, the variable HPRTEMP acquires a value of −0.20.

This negative value of HPRTEMP indicates that the present, actual rotor temperature lags behind the actual rotor temperature which will be attained once steady state at the higher N2 is attained. (A positive valve of HPRTEMP indicates the converse: present temperature is above steady-state temperature for present speed.) The attainment of steady state by HPRTEMP will now be explained.

At the next iteration, the value of N2 is still 9,000 rpm, as before. Similarly, stabilized rotor temperature is still 0.95, and is a negative input to summer 149. Both Z-block 153 and summer 149 add to this negative input the last scheduled value, which is 0.95, thus providing an output of summer 149 of 0. This output is fed to summer 157, and is added to the last previous signal at point 163 by Z-block 161. This last signal was −0.20, so the output of summer blank 157 is still −0.20. Consequently, the value of HPRTEMP is still at −0.20 at this point in time.

The reader will note that the value of HPRTEMP of −0.20 after the first iteration was caused by summer 149: the output of summer 157 was 0. However, in the second iteration, the output of summer 149 was zero and the output of summer 157 was −0.20. The output of summer 157 is maintained at −0.20 during subsequent iterations by Z-block 161 so long as the decay signed on line 165 is unity. The decay of the −0.20 value to zero by a change in the decay signal is discussed at the end of this section.

The previous example has been oversimplified, at least in the sense that the speed with which the variable N2 changed values, when compared with the speed with which the software does the computation described in FIG. 7, has been greatly exaggerated for purposes of illustration. In fact, the fastest acceleration of N2 to be expected is of the order of 1500 rpm's per second. In contrast, the length of time for the control computer to process the computation illustrated in FIG. 7 is in the order of 120 milliseconds (i.e., 0.120 second).

Figure 15A:
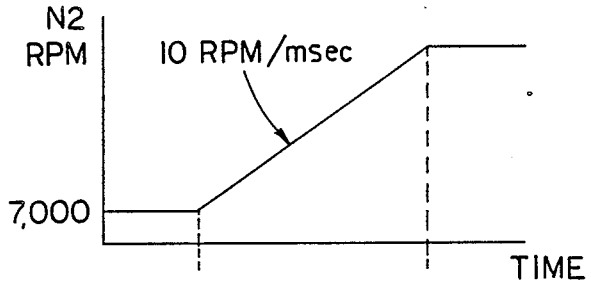
FIGS. 15A–15C illustrate the time behavior of two signals of FIG. 7.
Figure 15B:
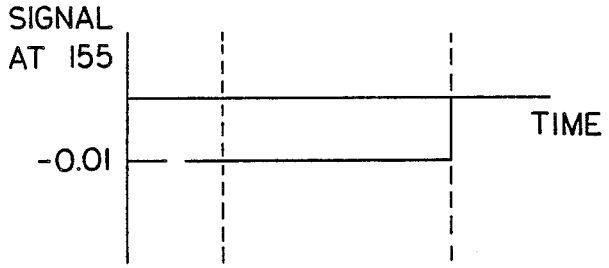
Figure 15C:
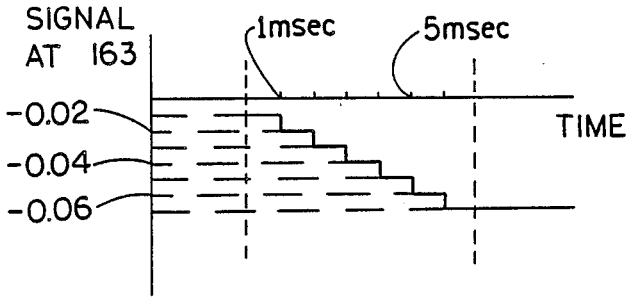

A second, slightly more complex example, will illustrate this point. Three important variables change during this example, namely, rotor speed (N2), and the values of the two signals at points 155 and 163 in FIG. 7, and plots of these changes occurring in this example are shown in FIGS. 15A–15C.

Let it be assumed that the length of time to execute the computation between point 175 (on the left) and point 177 (on the right) is one millisecond (0.001 second). Let it also be assumed that the rotor speed, indicated by N2, is accelerating at the rate of ten rpms per millisecond, beginning with a steady-state value of 7,000 rpm. As before, just before the onset of the acceleration, HPRTEMP has a value of 0. Now, assume that a ten rpm increment in N2 occurs, giving N2 a value of 7010 rpm. At this point in time, the computation at point 175 in FIG. 7 begins. Stabilized rotor temperature corresponding to 7010 is 0.76, but not shown. Thus, −0.76 is added at summer 149 to previous value of 0.75 provided by Z-block 153, giving a value of −0.01 at point 155. This is added by summer 157 to the last previous value at point 163, which was 0, giving an output at point 163 of −0.01. Assume, again, the value of signal on line 165 is unity. Therefore, HPRTEMP now has a value of −0.01.

However, the rotor is continuing to accelerate so that at the time the computation returns to point 175, the rotor speed is now 7020 rpm. Normalized temperature for this speed is 0.77, and so −0.77 is added in summer 149 to the previous value provided by Z-block 153 which is +0.76, giving a value of −0.01 at point 155. The computations to the right of point 155 are the same as in the preceding paragraph. This value of −0.01 persists during the acceleration, until a constant speed is attained.

The signal on line 165, produced by the decay rate schedule 142, has been assumed to be unity. However, in fact, the value of the decay signal is a function of N2, and the signal is generally between 0.9 and unity, as indicated. The decay signal determines how fast HPRTEMP will approach zero. For instance, in the first example given above, during the second iteration, the output of summer 149 was zero, but the signal on line 159 was −0.20. Further, the value at point 163 is also −0.20. In the example, it was pointed out that the value at point 163 remains at −0.20 after the second iteration so long as the decay signal remains at unity. However, it is now assumed that the decay signal equals 0.9. Now, the value at point 163 will become −0.18 (i.e., 0.9×−0.20). During the next iteration, this value of −0.18 is applied to summer 157, giving a summer output of −0.18, which is then multiplied by the decay signal, giving a value of −0.162 at point 163 (0.9×−0.18 equals −0.162.) This continual multiplication by the decay rate brings HPRTEMP to approach zero. (A step in the computer program sets HPRTEMP to zero when HPRTEMP falls below a certain value, such as 0.005. That is, HPRTEMP does not asymptotically approach zero forever.)

The decay rate schedule is generated from tests of the turbine with which the present invention is to operate, so that HPRTEMP decays to zero in the same time that the turbine rotor takes to reach its stabilized temperature. Therefore, HPRTEMP is caused to mimic the rotor temperature following changes in rotor speed.

A system for estimating deviation of rotor temperature from steady-state value based on rotor rpm has been described. This deviation from steady-state value, indicated by HPRTEMP, is used to compute the required temperature to which the shroud (more precisely, the rings 104 in FIG. 1B) must be driven. The computation of required, or demanded, shroud temperature will now be discussed.

Demanded Shroud Temperature Computation

Figure 8:
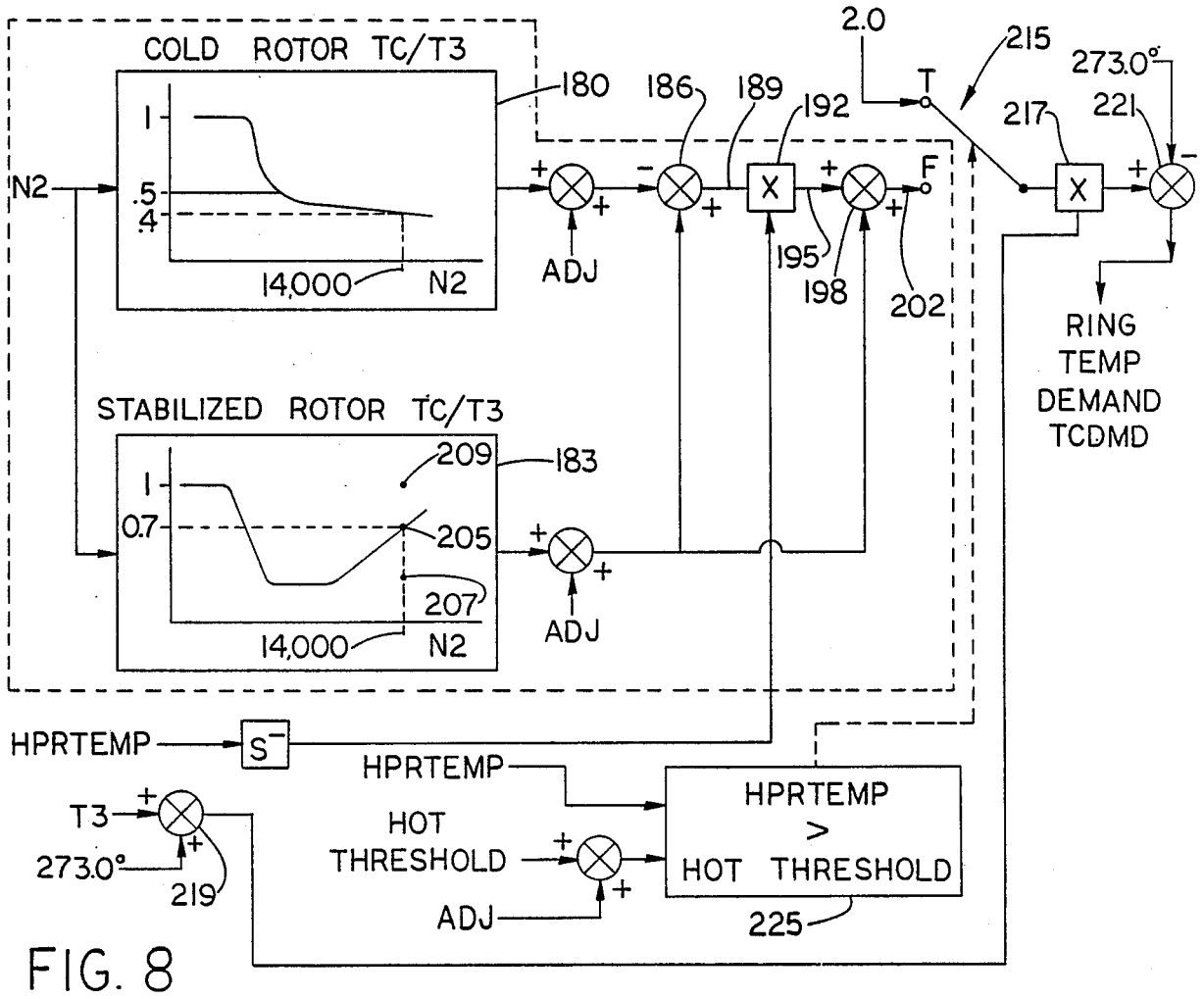

In FIG. 8, rotor speed, N2, is fed to two schedules, namely, a cold rotor schedule 180 and a stabilized rotor schedule 183. These two schedules, in the same manner as schedule 140 in FIG. 7, associate a temperature ratio ($T_C/T_3$) with every rotor speed, the latter being on the horizontal axis in each schedule. $T_C$ is demanded shroud temperature and $T_3$ is the temperature of the ninth stage compressor bleed. The reason for dividing $T_C$ by $T_3$ will be explained later.

A simplified explanation of the use of schedules 180 and 183 in FIG. 8 will first be given, followed by a more detailed explanation. In simplified terms, the schedules 180 and 183 plot the parameter $T_C/T_3$ as a function of core speed, N2, both for a cold rotor and for a stabilized rotor. The computation of FIG. 8 interpolates between the two schedules based on rotor temperature, indicated by HPRTEMP as follows. Let it be assumed that core speed, N2, is 14,000 rpm, giving schedule temperatures of 0.7 and 0.4 for a stabilized rotor and a cold rotor, respectively, as indicated. (Again, as in schedule 140 in FIG. 7, temperature is not given in degrees.) Summer 186 subtracts the cold rotor temperature from the stabilized rotor temperature, giving a result of +0.3 at line 189. This difference of 0.3 is multiplied by HPRTEMP in multiplier 192. (The reader will recall that HPRTEMP ranges from −1 to +1. Thus, in effect, the multiplication which occurs in multiplier 192 takes a percentage of the difference 0.3.) The product of multiplier 192, on line 195, is added to the stabilized rotor temperature in summer 198, thus providing an interpolation between the cold rotor schedule 180 and the stabilized rotor schedule 183 on line 202.

That is, FIG. 8 describes an interpolation of the following form: Value at point 202=(Stabilized rotor $T_C/T_3$ −cold rotor $T_C/T_3$)×HPRTEMP+Stabilized rotor $T_C/T_3$. If HPRTEMP equals 0.5, the interpolation simply takes the mean (i.e., average) value between the two schedules 180 and 183.

The effect of HPRTEMP upon the interpolation should be noted. If HPRTEMP is 0, indicating, as explained above, that rotor temperature is stabilized, then the output of multiplier block 192 is 0, causing the stabilized rotor temperature obtained from schedule 183 to be applied directly to line 202. If HPRTEMP has a value of −1, indicating that the rotor is very cold with respect to the stabilized operating temperature which it will attain if its present speed is maintained, the difference between the two schedules (i.e., the output of summer 186) is subtracted (in summer 198) from the stabilized schedule 183, and the result appears on line 202. This has the effect of lowering the scheduled shroud temperature, as from point 205 to point 207 in schedule 183, which is proper, inasmuch as the cold rotor requires a smaller, colder ring.

However, if HPRTEMP has a value of +1, indicating that the rotor is hot, as compared with the stabilized rotor temperature that would occur at the present operating speed, schedules 180 and 183 are not used, but $T_C/T_3$ is set to a constant value of 2.0 by the action of block 225, acting through switch 215: the signal reaching multiplier 217 is now 2.0.

The normalization of $T_C$ by $T_3$ in temperature schedules 180 and 183 will now be considered. $T_3$ is the temperature of ninth stage compressor air. This air is also vented into the cavity containing rotor 123 in FIG. 1A, as indicated by arrow 212. The reasons for the venting are unconnected with the clearance control of the present invention. However, this ninth stage bleed air tends to raise the temperature of the rotor, thus expanding the rotor. Consequently, $T_3$ affects the rotor diameter, because $T_3$ thermally expands the rotor. Therefore, $T_3$ is used to normalize $T_C$ in schedules 180 and 183 in FIG. 8, and an example will explain this normalization in more detail.

For example, if $T_C$ is large, corresponding to a hot rotor having a large diameter, then $T_3$ must also be large in for the ratio $T_C/T_3$ to equal the value scheduled. For example, if the scheduled value is 0.4 as indicated in schedule 180, and if $T_3$ has a value of 370°, then in order for the ratio $T_C/T_3$ to equal 0.4, scheduled $T_C$ must equals 148°. If $T_3$ had a lower value, such as 200°, then for the same scheduled value of 0.4, $T_C$ must equal 80°. Therefore, this example illustrates that $T_3$ normalizes the scheduled $T_C$ by modifying the $T_C$ according to the thermal state of the rotor as indicated by ninth stage compressor bleed. In the example, a larger $T_3$ induces a larger $T_C$, because a hotter, expanded rotor requires a hotter, expanded shroud.

This discussion now returns to the computation of demanded shroud temperature following the interpolation between schedules 180 and 183. Assuming that switch 215 connects point 202 to multiplier 217, then the denominator in the ratio $T_C/T_3$ is removed in multiplier block 217 by multiplication by $T_3$. The previous addition of the value 273 in summer 219 converts $T_3$ temperature to degrees Kelvin, which is absolute temperature. This conversion to an absolute scale is done because thermal expansion is, in the first order approximation, proportional to absolute changes in temperature.

The output of multiplier 217 is re-converted to degrees centigrade by subtraction of 273 in summer 221. The output of summer 221 is TCDMD, which is the demanded temperature to which the shroud should be brought.

If the switch 215 is in the position shown, contrary to that assumed above, the position shown results from the comparison made in block 225. This comparison has determined that HPRTEMP (which indicates the amount of deviation of rotor temperature from steady-state temperature at the present speed) exceeds a hot threshold, and, accordingly, TCDMD is doubled by multiplying by the factor of 2.0. The doubling is necessary because a rapid, large expansion of the shroud is required because of the excursion of HPRTEMP past the threshold. An example requiring this doubling of TCDMD is the following.

After a rapid deceleration of the engine, the gas stream 489 in FIG. 1 cools significantly, allowing the shroud 36 to cool and shrink. However, the thermal mass of the rotor 123 is large, and so the rotor does not shrink a corresponding amount. Therefore, TCDMD is doubled in order to call for an expansion of the shroud.

A method of computing TCDMD by interpolating between cold and hot rotor schedules, normalized by $T_C$, and based on HPRTEMP, has been described. Once TCDMD, the demanded shroud temperature, has been computed, the PID ring temperature controller 133 in FIG. 6 generates a signal, HPTCDMD 1, which indicates the percentage position to which valve poppet 94 in FIG. 1A should be driven. The ring temperature controller is shown in greater detail in FIG. 9.

PID Controller

Figure 9:
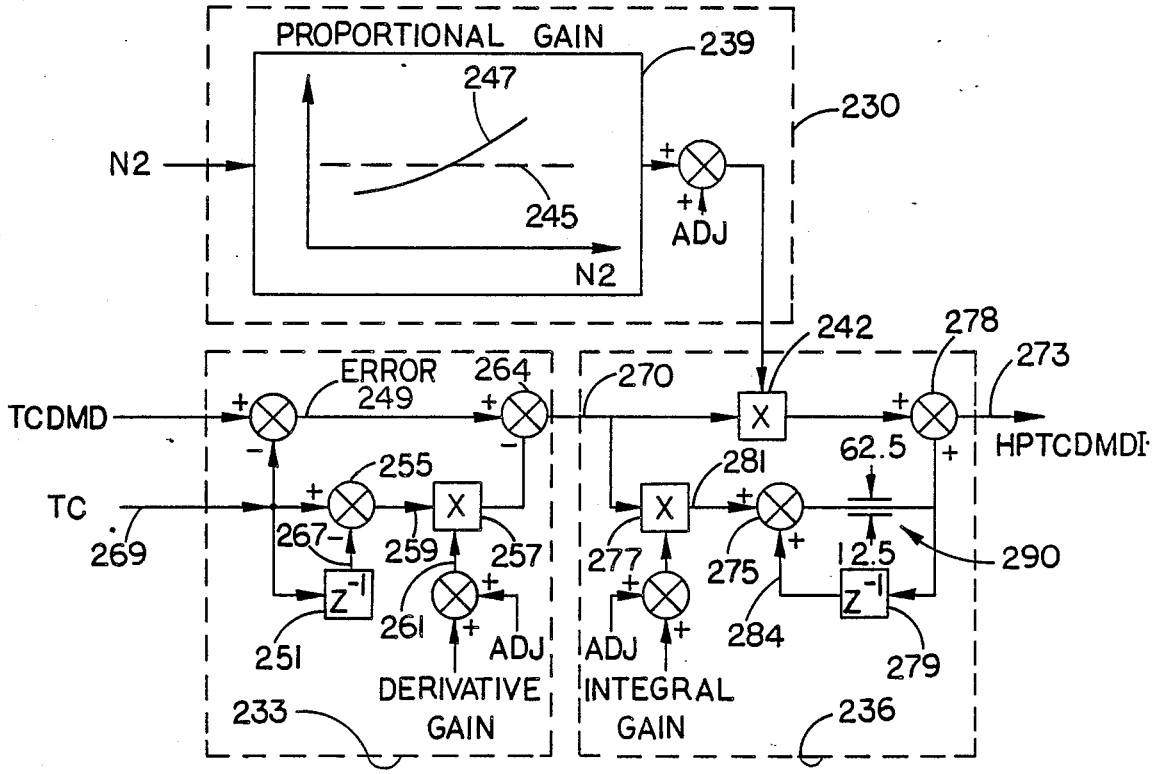

The controller in FIG. 9 is a proportional, integral, derivative controller (PID), implemented digitally, as known in the art. The proportional aspect is illustrated in box 230, the derivative aspect in box 223 and the integral aspect in box 236. A gain schedule 239, scheduling gain according to N2, core speed, applies the scheduled gain to multiplier 242. In the preferred embodiment, the gain is actually constant, as indicated by dashed line 245. However, situations can be envisioned wherein the gain changes as a function of N2, as indicated by solid schedule 247, in order to compensate for a change in the dynamics of the system illustrated in FIG. 1A as core speed changes. For example, at high engine speeds, the shroud temperature responds faster to changes in the air delivered by manifolds 101 in FIG. 1A because the mass flow rate through the manifolds is greater than at low speeds. Thus a gain function 247 in FIG. 9, which is scheduled as a function of speed, is shown.

The derivative aspect of the controller, in box 233, derives an error signal between measured shroud temperature, $T_C$, and demanded shroud temperature, TCDMD. The error signal is on line 249. Z-block 251 and summer 255 subtract from the current measured shroud temperature, $T_C$, on line 269, the last measured shroud temperature, $T_C$, and the difference is presented to multiplier 257 on line 259. This temperature difference on line 257 is the change in shroud temperature occurring over the time period between the present computational iteration and the last iteration. In the limit, as the time period approaches 0, the difference approached is a true time derivative. The time difference is multiplied by the derivative gain provided on line 261, and subtracted from the error signal in summer 264.

The reader will note that if the derivative (i.e., difference) signal on line 259 is very small, indicating that shroud temperature, $T_C$, is changing at a very slow rate, and if the derivative gain on line 261 is unity, then the modification to error signal 249 occurring in summer 264 by the derivative signal on line 259 is small. Restated, small rates of change of shroud temperature have little influence upon the error signal on line 249.

Conversely, if a large, rapid, swing in shroud temperature occurs, then a large derivative signal is applied to summer 264.

An example will illustrate one phase of operation of the derivative controller. Let it be assumed that demanded shroud temperature, TCDMD, exceeds actual shroud temperature, $T_C$, so that an error signal exists on line 249, and has a positive sign. Further, let it be assumed that $T_C$ has recently dropped drastically, thus providing a large derivative signal on line 259, which is negative. (The negative sign arises because the last previous $T_C$, on line 267, is given a negative sign as indicated. The drop of $T_C$ means that the last $T_C$ is larger than the present $T_C$, and so (present $T_C$)−(last $T_C$) is negative.) The negative derivative on line 259 is subtracted in summer 264, thus making more positive the already positive error signal.

Qualitatively, this can be viewed as a situation in which a suddenly shrunken shroud, when accompanied by a demand for a much larger shroud, causes the error signal on line 249 to be drastically increased in magnitude by the derivative signal on line 259. Restated, a rapid change in shroud temperature in a direction which increases the error signal on line 249, causes a further increase in the error signal due to the derivative on line 259. On the other hand, a rapid change in shroud temperature which serves to decrease the error signal on line 249, causes the error signal to be further diminished, as the following example will show.

Assume, as above, that demanded shroud temperature, TCDMD, exceeds actual shroud temperature, with the result that a positive error signal appears on line 249. Further assume that shroud temperature $T_C$ has been rapidly rising, so that the previously measured shroud temperature, on line 267, is smaller than the present temperature on line 269, thus giving a positive derivative signal on line 259. This positive derivative signal is subtracted in summer 264, thus having the effect of reducing the error signal on line 249.

Stated in other terms, if actual shroud temperature happens to be moving in the direction of demanded shroud temperature, the derivative controller reduces the error signal on line 249 by use of summer 264. Conversely, if the actual shroud temperature is moving away from demanded shroud temperature, the error signal on line 249 is increased by summer 264. The amount of increase and decrease of the error signal is a function of both the time rate of change of the shroud temperature (on line 259) and the derivative gain applied to multiplier 257. In general, the greater the rate of temperature change, the greater the modification to error signal 249.

The integral aspect of the PID controller will now be considered. In simple terms, the integral controller 236 produces a time integral of the signal appearing on line 270. The signal on line 270 is the output of the derivative block 233, which includes the error signal on line 249, which is (TCDMD minus TC). The signal on line 270 will be termed a P/D-error signal 270.

For example, a small, constant, P/D-error signal becomes integrated into a rising error signal on line 273. That is, the magnitude of the integrated signal 273, and thus its influence upon the system, depends upon the lifetime of the P/D-error signal 270, as well as upon its magnitude. Restated, a small, long-lived P/D-error signal 270 has a generally similar influence as a large, short-lived P/D-error signal.

The P/D-error signal is applied to summer 275, after having been multiplied by the integral gain in multiplier 277. The last previous output of summer 275 is then added to summer 275 through Z-block 279, and the output of summer 275 is added to the original P/D-error signal on line 270 in summer 278, the latter having been multiplied by the proportional gain in multiplier 242. A numerical example will illustrate this.

If the P/D-error signal 270 is assumed to be 0.1 (arbitrary units) and the integral gain is assumed to be unity, and if it is further assumed that this value of 0.1 on line 270 represents a sudden jump from a value of 0, then the input to summer 275 on line 281 is 0.1. Input from Z-block 279 on line 284 is 0. Thus, the output of summer 275 is 0.1, which is added to the error of 0.1 in summer 278 giving an output on line 273 of 0.2. During the next iteration, the 0.1 P/D-error on line 270 is added to the last output of summer 275 by Z-block 279, which is 0.1, resulting in a present output of summer 275 of 0.2, which is added to 0.1 in summer 278, giving a present output of 0.3 on line 273, and so on. Therefore the output on line 273 continually increases in response to a constant input.

The output of summer 275 is limited between values of 12.5 and 62.5 by limiter 290.

The output of the PID controller is a variable HPTCDMDI, representing the demanded valve position for valve poppet 94 in FIG. 1A. The signal HPTCDMDI is, in effect, a percent ranging from 0 to 100, and selects one of the valve positions as described in connection with FIG. 3.

Figure 14:
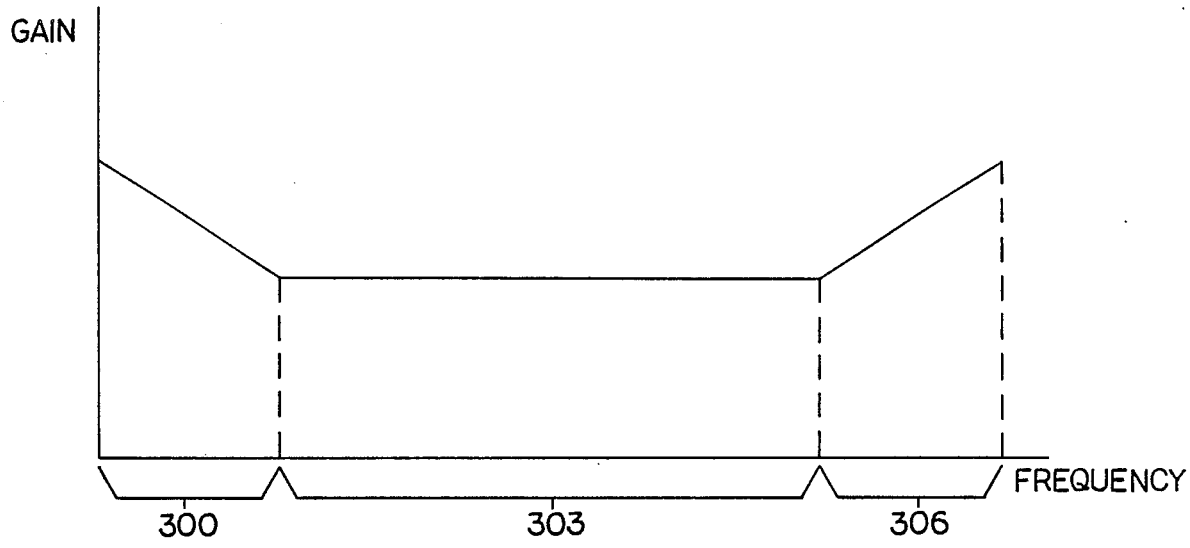
FIG. 14 illustrates a Bode diagram of a Proportional-Integral-Derivative Controller.

One significant feature of the use of a PID controller lies in its associated Bode plot, which is shown in FIG. 14. In the Bode plot, system gain is plotted as a function of frequency. Two points should be noted. First, gain refers to the amount of shroud heating as compared with the error signal on line 249 in FIG. 9. In general, a large amount of heating in response to a small error signal represents a large gain.

Second, frequency has a different meaning in the Bode plot than is commonly understood. That is, the frequency in FIG. 14 refers to a frequency variable in the frequency domain in which a LaPlace transform exists. When the time-domain mathematical equation representing the PID controller in FIG. 9 is converted into the frequency domain by taking its LaPlace transform, a purely mathematical operation has been undertaken. The transformed equation becomes a function of an independent variable, s, which is frequency., in the time domain, the independent variable was t, time. However, in fact, the PID controller will rarely see an error signal in sinusoidal form, which is the type commonly considered as having a frequency. Rather, the term frequency in the Bode plot has, perhaps, more meaning when referring to the rate of change of error signals. That is, rapidly changing signals are considered to be high-frequency, while slowly changing signals are considered low-frequency.

In the present invention, the Bode plot indicates that system gain decreases with increasing frequency in region 300, levels off somewhat in region 303, and then increases with increasing frequency in region 306. Region 300, the low-frequency region, is more influenced by the integral controller while region 306, the high-frequency region, is more influenced by the derivative controller, while region 300, the level region, is more influenced by the proportional controller.

The demanded valve position, HPTCDMDI, produced by the PID controller is not applied directly to the valve 80 in FIG. 1A, but is modified and limited as described in FIG. 10, for reasons which will now be discussed.

Limits To Valve Poppet Position

Figure 10:
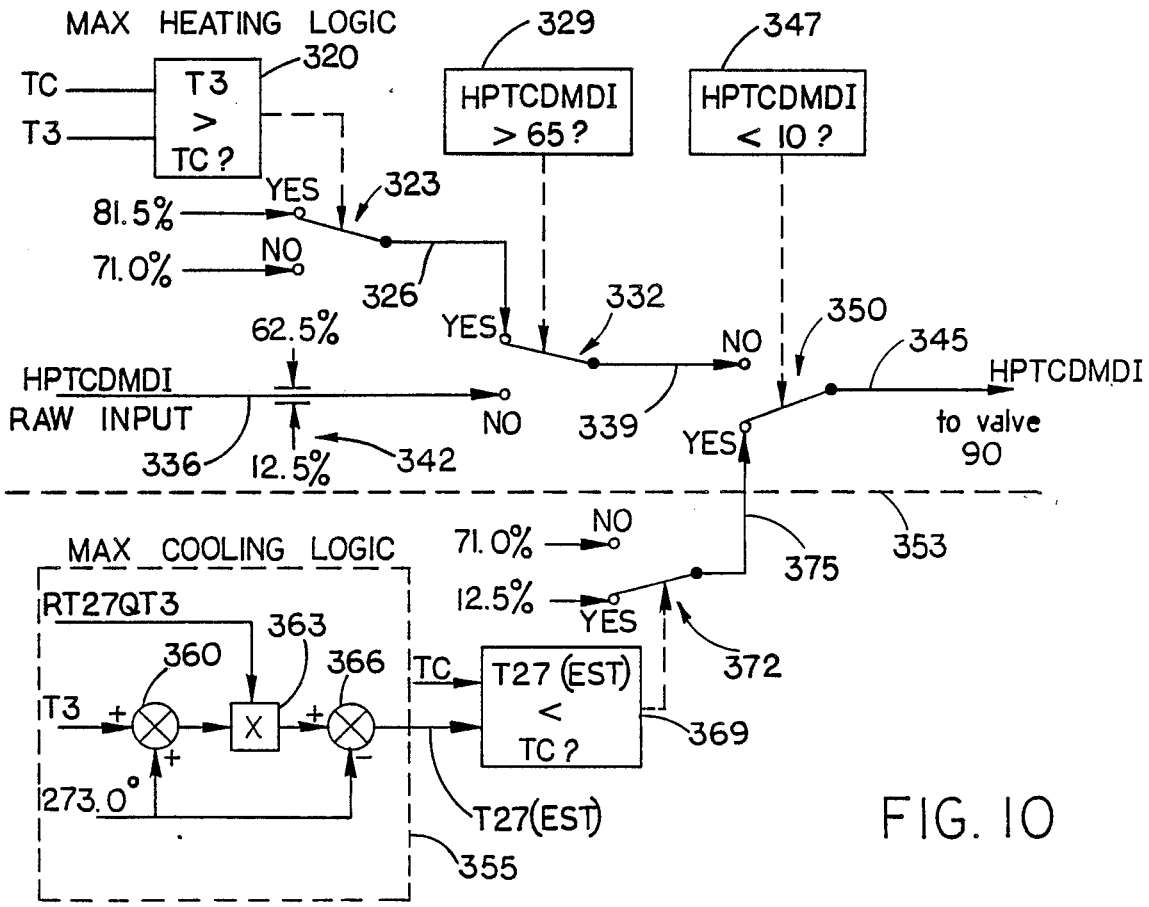

In FIG. 10, comparator 320 inquires whether $T_3$ exceeds $T_C$, which is equivalent to inquiring whether ninth stage compressor bleed is hotter than measured shroud temperature. If so, indicating that the rotor is in a highly expanded state because of the ninth stage bleed air impinging upon it, then comparator 320 causes switch 323 to apply an 81.5% signal to line 326. This signal refers to the valve position shown in FIG. 3E.

Viewed another way, comparator 320 decides whether to apply super ninth air (the 81.5% position in FIG. 3E) or zero air (the 71% position in FIG. 3D) to the shroud when maximum heating is desired. For maximum shroud heating, super ninth air is better if $T_3$ exceeds $T_C$, but if $T_3$ does not exceed $T_C$, then zero air is preferred for heating the shroud.

If $T_3$ does not exceed $T_C$, then switch 323 applies a 71% signal to line 326. The signal on line 326 is used only if comparator 329 finds that HPTCDMD (i.e., demanded valve position) exceeds 65%, indicating that a large amount of shroud heating, in excess of the modulation range, (i.e., the range of 12.5% to 62.5%) is demanded. If so, then either the 71% or 81.5% signal from switch 323 in comparator 320 is used, depending upon rotor temperature as inferred from ninth stage bleed temperature, $T_3$.

If comparator 329 indicates that a large shroud expansion is not required, then switch 332 applies HPTCDMDI, on line 336, to line 339. Another way to view the operation just described is the following.

If comparator 320 indicates that ninth stage air is hotter than the shroud, then the 81.5% signal, calling for large shroud heating, is applied to line 326 and is then applied to valve 80 in FIG. 1A if comparator 329 in FIG. 10 indicates that a large (more than 65% valve position) shroud expansion is demanded by the PID in FIG. 9.

If ninth stage air is not hotter than the shroud, as determined by comparator 320 in FIG. 10, then the 71% signal is applied to line 326 and is used if comparator 329 determines that a large (more than 65%) shroud expansion is being demanded. However, irrespective of whether ninth stage air is hotter than the shroud, as deduced in comparator 320, if comparator 329 determines that a large shroud expansion is not being demanded (less than 65% is demanded), then the demanded valve position, HPTCDMDI, on line 336, as limited between 12.5 and 62.5% by limiter 342, is applied to line 339.

The signal on this latter line 339 is applied to line 345, which leads to valve 90 in FIG. 1A, if comparator 347 determines that shroud cooling is not being demanded. The absence of shroud cooling demand is indicated by a value of HPTCDMDI which does not fall below 10%, thereby causing switch 350 to attain the NO position. If switch 350 is in the YES position, indicating that shroud cooling is demanded, then the cooling logic below the dashed line 353 determines the signal applied to line 345.

Box 355 in the cooling logic estimates $T_{27}$, which is the temperature of the fifth stage compressor bleed, from the measured temperature of the ninth stage bleed, $T_3$. Two reasons for this are, (1) direct measurement of fifth stage bleed would require an additional temperature sensor, with associated circuitry, and (2), the fifth stage temperature is, generally speaking, a known fraction of ninth stage temperature.

In box 355, $T_3$, ninth stage bleed temperature, is first converted to degrees Kelvin in summer 360, and then multiplied by $RT27QT_3$ in multiplier 363. $RT27QT_3$ is the known fraction described above. Then, in summer 366, the output of multiplier 363 is returned to centigrade units, and the output of summer 366 is an estimated fifth stage bleed temperature, $T_{27}$ (est.)

Comparator 369 compares $T_{27}$ (est.) with shroud temperature, $T_C$. If shroud temperature exceeds $T_{27}$ (est.), meaning that the fifth stage bleed is colder than the shroud, then switch 372 applies the 12.5% signal indicated to line 375. As discussed above in connection with FIG. 3B, this has the effect of applying only fifth stage air to the shroud. Under these circumstances, the shroud shrinks because fifth stage air is colder than the shroud.

However, if comparator 369 indicates that fifth stage bleed is hotter than the shroud, then the 71% signal is applied to line 375. As FIG. 3D indicates, the 71% signal causes the valve 80 to block all bleed airflow to the shroud. The shroud then attains a temperature unaffected by compressor bleeds. In one sense, no active clearance control is applied when fifth stage bleed is hotter than shroud temperature.

Restated, comparator 369 decides the way to keep the shroud as cold as possible. Fifth stage compressor bleed is the coldest bleed available, but under some conditions it can be hotter than the shroud. Thus, comparator 369 chooses fifth stage bleed (i.e., the 12.5% position) if $T_{27}$(est) is less than $T_C$. If $T_C$ is less than $T_{27}$(est), then no air (i.e., the 71% position) is chosen.

Another way to view the maximum cooling logic is the following: if comparator 347 indicates that shroud cooling is being demanded, then cooling occurs only if fifth stage air (the cooler of fifth and ninth stages) is cooler than the shroud. If not, airflow to the shroud is blocked by the 71% position of valve 80 in FIG. 1A. It should be noted that the preceding applies only if a back-up system has not taken over control of shroud airflow. The back-up systems will now be discussed.

BACK-UP SHROUD TEMPERATURE COMPUTATION

Transient Detection

Figure 11:
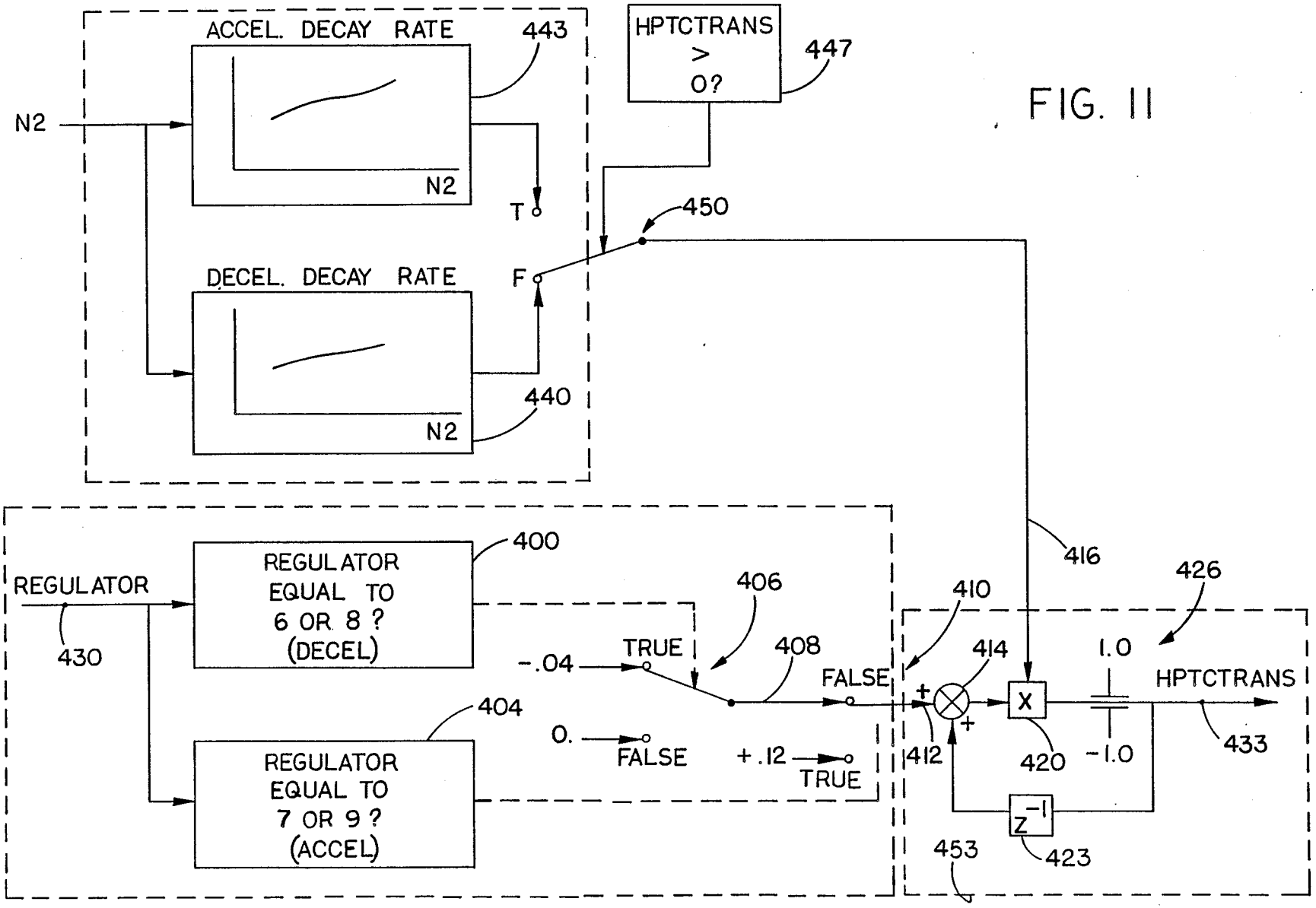

The back-up system can be viewed as including three components, namely, a component which ascertains the occurrence of a transient (i.e., an acceleration or a deceleration), a component which computes a back-up valve position for use during the transient, and a component which computes a back-up valve position for use during steady-state operation. The component which ascertains the occurrence of a transient is shown in FIG. 11.

In that figure, a regulator (not shown) provides a signal to blocks 400 and 404. The regulator is a component, known in the art, associated with the engine fuel control (again not shown), which is also known in the art. As block 400 indicates, a regulator value of either 6 or 8 indicates that a deceleration is occurring, while block 404 indicates that a regulator value equal to either 7 or 9 indicates that an acceleration is occurring. As to the former case, if a deceleration is occurring, switch 406 applies a −0.04 signal to line 408. Of necessity, a second switch 410 will occupy the false position, because the answers to the inquires of blocks 400 and 404 are mutually exclusive; they cannot both be true or both be false. Therefore, during a deceleration a signal having a value of −0.04 is applied to input 412 of summer 414.

Ignoring, at present, the effect of any signal which may be applied on line 416 to multiplier 420, during each iteration, summer 414 and Z-block 423 cause the variable HPTCTRANS to decrease by 0.04 during each computational iteration. The decrementing continues until HPTCTRANS reaches a limiting value of −1, shown by limiter 426.

Similarly, during an acceleration, switch 410 will be in the true position, causing HPTCTRANS to increment by the value of +0.12 during each iteration, and reach a limit of +1 as indicated by limiter 426. The programming steps indicated between point 430, on the left, and point 433, on the right, are executed in less than 120 milliseconds. Therefore, when blocks 400 and 404 indicate that either a deceleration or an acceleration is occurring, HPTCTRANS rapidly attains a value of either positive or negative 1, generally in five seconds or less.

The preceding discussion has ignored the effect any signal on line 416 may have on the computation of HPTCTRANS. Such signals will now be considered. Two decay rate schedules are contained in blocks 440 and 443, and these decay rates affect the rate at which HPTCTRANS is brought to 0 once the transient has terminated. Block 447 controls switch 450 which determines which schedule is used. An example will illustrate the decay of HPTCTRANS.

Once the transient has terminated, a zero signal is applied to input 412 of summer 414 because of the effects of blocks 400 and 404 on switches 406 and 410. If the signal on line 416 were unity, the computation indicated in box 453 would maintain HPTCTRANS at its present value indefinitely. However, the decay rates are actually numbers ranging from negative unity to positive unity; the acceleration decay rates in schedule 443 range from −1 to 0; the deceleration decay rates in schedule 440 range from 0 to +1. If, for example, HPTCTRANS has a value of −1, indicating that a deceleration has occurred, switch 450 is forced to the false position, applying a deceleration rate to multiplier 420. Assume the rate in block 440 is 0.9. Consequently, HPTCTRANS is multiplied by 0.9 during each iteration of box 453, which drives HPTCTRANS to very near 0 within twenty or thirty seconds.

One significant feature of the HPTCTRANS calculation is that HPTCTRANS attains a value of positive or negative unity only when the regulator indicates that an acceleration or a deceleration is occurring for a sufficient length of time which allows the repeated adding, in the case of an acceleration, of +0.12 to accumulate to unity. Viewed another way, a time-hysteresis is introduced. That is, merely a momentary indication by the regulator of an acceleration or deceleration will not bring HPTCTRANS immediately to +1 or −1 unless the momentary indication lasts long enough to allow sufficient iterations by summer 414 to drive HPTCTRANS to +1 or −1. When the momentary indication terminates, the signal on line 416 then decays HPTCTRANS to 0.

HPTCTRANS is, in some respects, similar to the variable HPRTEMP calculated in FIG. 7. That is, when HPTCTRANS has a value of plus or minus unity, an acceleration or deceleration, respectively, is occurring. When the acceleration or deceleration stops, HPTCTRANS gradually decays to 0. HPTCTRANS is used to compute the back-up demanded shroud temperature for use during a transient, as shown in FIG. 12.

Back-up Shroud Temperature Computation for Transient

Figure 12:
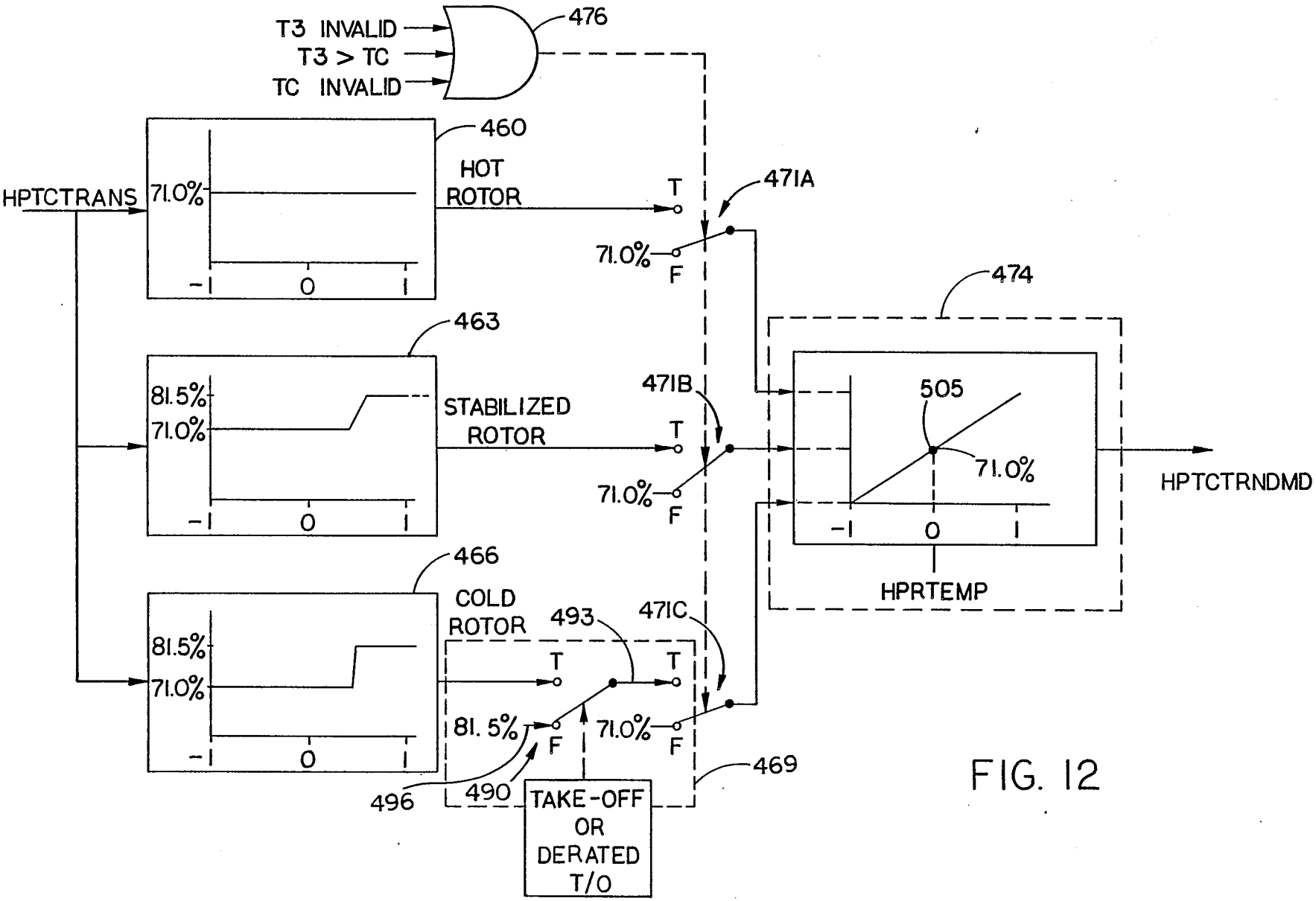

In FIG. 12, HPTCTRANS is fed to three schedules, one for a hot rotor (460), one for a stabilized rotor (463), and one for a cold rotor (466). The effect of box 469, at the bottom of the figure, will be ignored for the present. Let it be assumed that HPTCTRANS has a value of +1, indicating that an acceleration is occurring. The output of the hot rotor schedule 460 is 71%, and 81.5% from both the stabilized rotor and cold rotor schedules 463 and 466. Assuming, for the present, that switches 471A–C are all in the true position, block 474 interpolates among the three valve positions based on HPRTEMP.

The interpolation is done as follows. If HPRTEMP is greater than zero, block 474 interpolates between the hot schedule 460 and the stabilized schedule 463, in the manner of FIG. 8. If HPRTEMP is less than zero, block 474 interpolates between the cold schedule 466 and the stabilized schedule 463, again, as in FIG. 8.

As a result, a back-up, transient, demanded valve position, HPTCTRNDMD is computed. This back-up signal is fed to demand selection block 138 in FIG. 6 and transmitted to the valve 80 if conditions require.

Switches 471A–C are controlled by the output of OR gate 476. As indicated, if either measured $T_C$ or $T_3$ is considered to be invalid, switches 471A–C are driven to the 71% (false) position. Since, as indicated in FIG. 3D, the 71% valve position blocks compressor bleed from reaching the shroud, no heating or cooling air is applied when these measured temperatures are invalid. (The occurrence of the interpolation in box 474 does not affect this, because interpolation among three identical 71% values, applied by switches 471A–C, produces 71% as a result.)

Further, three 71% values are also fed to box 474 when $T_C$ exceeds $T_3$, as determined in OR-gate 476, meaning that ninth stage compressor bleed temperature ($T_3$) exceeds shroud temperature ($T_C$). This has the effect of terminating all air flow to the shroud during a condition known as a hot rotor reburst, which will now be explained.

When an aircraft pilot reduces throttle setting, as in making a descent for landing, core speed, N2, decreases, thereby reducing the centrifugal force applied to the rotor, thereby reducing the centrifugal stretching previously experienced. In addition, the temperature of the gas stream 489 in FIG. 1 impinging upon blades 21 is reduced, reducing the thermal growth of the blades, and, since this air also contacts the shroud 36, the diameter of the shroud becomes reduced as well, although the shrinkage of the shroud lags that of the rotor by a few seconds.

For various reasons, the pilot may request a sudden increase in thrust under these conditions, whereupon the turbine rotor 123 accelerates to a high speed. The rotor 123 experiences an expansion because of centrifugal force, which is nearly instantaneous and which decreases the clearance 33. Somewhat later, the heat of the airstream 489 causes the turbine blades to expand, further decreasing the clearance. While it may be desirable to expand the shroud at the time when the acceleration is occurring, the temperature of the ninth stage compressor bleed will, in general, be too low because of the low compression occurring during the time of reduced N2, as well as during the initial stages of the acceleration. Therefore, the engine is designed such that the cold diameter of the shroud 36 clears the rotor when the rotor experiences this instantaneous expansion.

Restated, no conveniently available source of hot air exists for expanding the shroud 36 during such reburst. Therefore, the shroud is manufactured to have a sufficient clearance 33 to clear the turbine blades during a hot rotor reburst. After the reburst, when $T_3$ exceeds $T_C$ (i.e., ninth stage bleed becomes hotter than the shroud), switches 471A–C in FIG. 12 all reach their respective true conditions, and a value between 71% and 81.5% is fed to the valve in the form of HPTCTRNDMD. As shown in FIGS. 3D and 3E, these percentage values represent part or all of the super-ninth bleed available, which is the hottest compressor bleed available. Accordingly, the shroud 36 is forced to grow thermally along with the thermal growth of the rotor.

Box 469, at the bottom of FIG. 12, will now be considered. Switch 490 refers to a switch under the control of the pilot by which the pilot indicates whether a takeoff or a de-rated takeoff is occurring. One type of derated takeoff is that occurring on a hot day such as 100° F. On such a hot day, full throttle is not used, but a reduced throttle setting is selected. This causes the rate of fuel delivery to the combustor to be reduced, thereby reducing the amount of heat given off by the burning fuel, thereby reducing the temperature of the gas stream 489 in FIG. 1 reaching the turbine blades 21. If fuel flow were not reduced, the incoming 100° air, as compared with more usual 60° air, in effect, adds 40° to the temperature of the gas stream impinging the turbine blades. This excessive temperature can damage the turbine blades, and so the reduced fuel flow is used to reduce the heat supplied by the combustor in order to compensate for the increased heat supplied by the atmosphere.

Under these conditions of takeoff or de-rated takeoff, switch 490 in FIG. 12 is in the true position, feeding the valve position scheduled in the cold rotor schedule 466 to line 493. However, in the absence of takeoff or derated takeoff, the 81.5% signal on line 496 is fed to line 493. This 81.5% signal (i.e., super-ninth) has the effect of preventing the termination of airflow to the shroud when slow accelerations occur.

During a slow acceleration, HPTCTRANS, computed in FIG. 11, can have a near 0 value, because the decay rate signal on line 416 can tend to cancel the incrementing or decrementing occurring by the signal on line 412. Therefore, the valve position scheduled by schedule 474 in FIG. 12 can be as shown by point 505, which is the 71% position, which terminates airflow. Viewed another way, the cold rotor schedule 466 contains scheduling information that is only relevant when the rotor is cold, that is, just before takeoff. At times when such information is relevant, the pilot causes switch 490 to be in the true position. Otherwise, switch 490 is in the false position, applying the 81.5% signal to line 493.

Back-up Shroud Temperature For Steady-State

Figure 13:
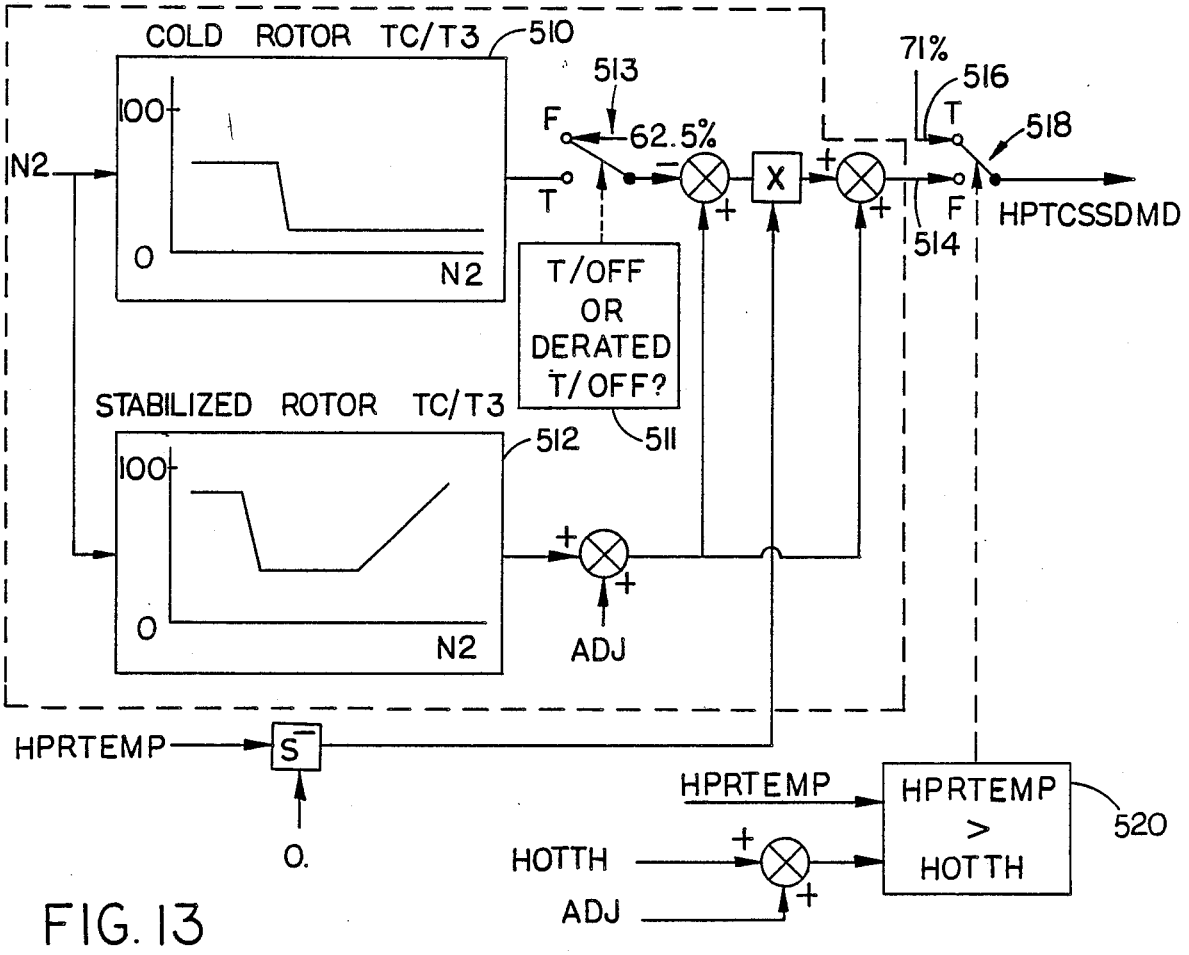

FIG. 13 will now be discussed, which describes the shroud temperature demand computed for the back-up, steady-state case. (The term "steady state" refers to the situation when core speed, N2, is constant, instead of accelerating or decelerating. This term should not be confused with the term "stabilization" used above in connection with rotor temperature. For example, speed N2 can be at steady state, yet the rotor need not be at a stabilized temperature.)

Interpolation between schedules 510 and 512 in FIG. 13 is undertaken, based on HPRTEMP. This interpolation is similar to that undertaken in FIG. 8 and the discussion given for that figure applies to this interpolation as well. In addition, for reasons similar to those discussed in connection with block 469 in FIG. 12, block 511 in FIG. 13 selects the cold rotor schedule 510 when the pilot indicates that a takeoff or derated takeoff is occurring. Otherwise, the 62.5 percent (regular ninth) position is selected.

The interpolation provides a percent valve position at point 514. Whether this interpolated valve position is used, or the 71% (no air) position at point 516 is used, is determined by switch 518. Switch 518 is controlled by comparator 520 which inquires whether the deviation of rotor temperature from steady state, indicated by HPRTEMP, exceeds a limit, HOTTH. If so, airflow to the shroud is terminated, because switch 516 attains the true position. The output of switch 518 is a back-up, steady-state, shroud temperature demand, HPTCSSDMD. Schedules 510 and 512 are generated from engine performance data in the same manner as schedules 180 and 183 in FIG. 8.

The two back-up demand signals, HPTCSSDMD from FIG. 13 and HPTCTRNDMD in FIG. 12, are fed to demand selection block 138 in FIG. 6 as indicated. Further, the transient indicator signal, HPTCTRANS, is fed to the demand selection block, as is the output HPTCDMD, of the PID controller in FIG. 9, as limited in FIG. 10. The demand selection block 138, based on signals T3SST and TCSST, which indicate whether the signals $T_C$ and $T_3$ are valid and should be believed, selects one of the three shroud demand signals (i.e., HPTCDMD, HPTCRNDMD, or HPTCSSDMD) and delivers the selected signal, HPTCDMDO to a controller, known in the art, which drives the valve 80 in FIG. 1A to the percentage position indicated by HPTCDMD.

Signals TCSST and T2SST are derived in a manner known in the art.

GENERAL CONSIDERATIONS

Several important aspects of the invention are the following.

1. The PID controller 133 in FIG. 6 does not affect the back-up signals produced by blocks 128 and 130. Restated, when a back-up signal is used, it is used without modification by the PID controller.
2. The decay rate schedule 142 in FIG. 7, used to drive the stability indicator HPRTEMP to 0, in general, has a value between 0.9 and 1.0 as indicated. The exact form of schedule 142 is determined empirically. That is, the second spool (i.e., the high-pressure compressor 18 and turbine 21 in FIG. 1) is accelerated from one speed to a second speed and the length of time taken to reach steady-state operating temperature at the second speed is measured. The process is repeated in order to obtain sufficient data to generate the decay rate in schedule 142 in FIG. 7.

Further, the exact form of the decay rate schedule will depend upon the length of time needed by the computer to return to point 175, on the left in FIG. 7, after executing the rest of its tasks, such as computing the logic described in FIGS. 8–13. (Schedule generation is known in the art.) As a result, HPRTEMP will decay to 0 in a manner which tracks, or parallels, the approach of the rotor temperature to its steady-state value.

3. The discussion above, with regard to the proportional and integral controller in FIG. 9, can be applied to Z-blocks 153 and 161 in FIG. 7. Such an application will show that Z-block 153 serves to provide a derivative signal at point 155, the derivative being the time derivative of rotor temperature, while Z-block 161 serves to integrate the signal present at point 163 but weighted by the decay rate in multiplier 167.
4. The interpolation described in FIG. 8 can also be viewed as an averaging, a weighting, or even an extrapolation. As to weighting and averaging, the difference between the two schedules 180 and 183, appearing on line 189, is weighted by HPRTEMP, and then added to stabilized rotor schedule 183 in summer 198.

A similar result can be obtained using an extrapolation. The maximum difference to be expected on line 189 is known, and that same maximum (instead of the output of summer 186) can simply be weighted by HPRTEMP in multiplier 192 and added to the stabilized rotor schedule 183. Alternately, the actual difference itself can be scheduled as a function of N2, and fed directly to multiplier 192, eliminating the need for subtraction by summer 186.

5. As discussed in the section above entitled "Rotor Temperature Computation," the temperature computed is modified depending upon whether the engine is undergoing a transient. For example, the discussion given in connection with decay rate schedule 142 indicates that, during an acceleration, steady state temperature of the rotor which would be attained at the present speed is modified by a delaying factor in order to mimic the actual delay which the rotor takes in reaching steady state temperature. At least in this example, rotor temperature is computed based on factors which include the time history of rotor speed.

Numerous substitutions and modifications can be undertaken without departing from the true spirit and scope of the invention as defined by the following claims.

We claim:

1. In a method of controlling the clearance between turbine blades and a shroud in a gas turbine engine, the improvement comprising the step of (a) computing a demanded temperature for the shroud, based on a historical record of turbine speed behavior.

2. A method of controlling tip clearance in a turbine in a gas turbine engine, comprising the following steps:

(a) ascertaining turbine rotor temperature;
(b) computing a demanded shroud temperature in response to the rotor temperature; and
(c) adjusting actual shroud temperature in response to the demanded shroud temperature.

3. A method according to claim 2 in which turbine rotor temperature is ascertained from rotor speed.

4. In a method of controlling clearance between turbine blades and a shroud in a turbine in a gas turbine engine, the improvement comprising:

(a) deriving a demanded temperature for the shroud from a turbine rotor temperature.

5. A method of controlling tip clearance in a turbine in a gas turbine engine, comprising the following steps:

(a) inferring rotor temperature from rotor speed;
(b) computing demanded shroud temperature in response to inferred rotor temperature; and
(c) adjusting actual shroud temperature in response to the demanded shroud temperature.

6. The method according to claim 1 and further comprising the following step:

(c) adjusting shroud temperature in response to the demanded shroud temperature.

7. The method according to claim 2 and further comprising the following steps:

(d) computing a back-up shroud temperature; and
(e) adjusting shroud temperature in response to the back-up shroud temperature when demanded shroud temperature is inaccurate.

8. A method of controlling tip clearance in a turbine in a gas turbine engine, comprising the following steps:

(a) calculating the deviation of rotor temperature from a steady-state temperature;

(b) computing demanded shroud temperature in response to the deviation; and
(c) adjusting actual shroud temperature in response to the demanded shroud temperature.

9. The method according to claim 4 and further comprising the following step:
(c) adjusting shroud temperature in response to the demanded shroud temperature.

10. The method according to claim 5 and further comprising the following steps:
(c) computing a back-up shroud temperature; and
(d) adjusting shroud temperature in response to the back-up shroud temperature when demanded shroud temperature is inaccurate.

11. In a method of controlling tip clearance in a turbine in a gas turbine engine, the improvement comprising:
(a) deriving a demanded temperature for the shroud for back-up use during transients; and
(b) deriving a demanded temperature for the shroud for back-up use during steady state.

12. A method of controlling tip clearance in a turbine in a gas turbine engine, comprising the following steps:
(a) deriving turbine rotor temperature from turbine rotor speed;
(b) deriving a demanded shroud temperature from the turbine rotor temperature;
(c) computing a back-up demanded shroud temperature based on derived rotor temperature and rotor speed; and
(d) adjusting actual shroud temperature in response to the demanded shroud temperature during normal operation.

13. A method of controlling tip clearance in a turbine in a gas turbine engine, comprising the following steps:
(a) deriving turbine rotor temperature from turbine rotor speed;
(b) deriving a first demanded shroud temperature from the turbine rotor temperature;
(c) computing a back-up demanded shroud temperature by interpolating between second and third demanded shroud temperatures; and
(d) adjusting the actual shroud temperature in response to the first demanded shroud temperature during normal operation.

14. A method according to claim 13 in which the second and third demanded shroud temperatures
(d) each correspond to a different rotor temperature, and the interpolation is based on the derived shroud temperature of (b).

15. In a method of controlling clearance between turbine blades and a shroud in a gas turbine engine, the improvement comprising the following steps:
(a) deriving turbine rotor temperature from turbine rotor speed; and
(b) computing a back-up demanded shroud temperature by interpolating between
(i) a first demanded shroud temperature corresponding to a first rotor temperature and
(ii) a second demanded shroud temperature corresponding to a second rotor temperature, and making the interpolation based on derived rotor temperature.

16. In a method of controlling clearance between turbine blades and a shroud in a gas turbine engine, the improvement comprising the following steps:
(a) deriving turbine rotor temperature from turbine rotor speed; and
(b) computing a back-up demanded shroud temperature by interpolating between a first demanded shroud temperature and a second demanded shroud temperature based on derived rotor temperature.

17. A method of controlling tip clearance in a turbine in a gas turbine engine, comprising the following steps:
(a) deriving turbine rotor temperature from turbine rotor speed;
(b) computing a demanded shroud temperature from the turbine rotor temperature; and
(c) computing a back-up demanded shroud temperature using the following steps:
(i) ascertaining the deviating of measured rotor temperature from a stabilized temperature;
(ii) ascertaining demanded shroud temperature for the stabilized temperature; and
(iii) modifying the demanded shroud temperature of (b) based on the deviation.

18. A method of controlling tip clearance in a turbine in a gas turbine engine, comprising the following steps:
(a) deriving turbine rotor temperature from turbine rotor speed;
(b) computing a demanded shroud temperature from the turbine rotor temperature; and
(c) computing a first, back-up, demanded shroud temperature using the following steps:
(i) ascertaining whether the engine is undergoing a transient and producing a transient signal in response;
(ii) in response to the transient signal, ascertaining demanded shroud temperatures for different rotor temperatures; and
(iii) deriving the first, back-up, demanded shroud temperature by interpolating between demanded shroud temperatures of (c)(ii).

19. A method of backing up an active clearance control for a turbine shroud in a gas turbine engine, comprising the following steps:
(a) computing a back-up shroud temperature needed for a turbine rotor operating at a reference temperature; and
(b) modifying the shroud temperature based on an inferred deviation of actual rotor temperature from the reference temperature.

20. A method of computing turbine rotor temperature for use in a control system in a gas turbine engine, comprising the following steps:
(a) measuring turbine rotational speed;
(b) maintaining a schedule of data pairs, each pair containing
(i) a turbine temperature and
(ii) a rotational speed;
(c) storing an intermediate signal (HPRTEMP) indicative of the turbine temperature paired with present rotational speed;
(d) when turbine speed changes, causing HPRTEMP to indicate the magnitude and direction of the change; and
(e) after a turbine speed change, causing HPRTEMP to return, at a controlled rate, to a value indicating steady-state operation.

21. A method of controlling shroud clearance in a gas turbine engine, comprising the following steps:
(a) computing the deviation of actual rotor temperature from steady-state rotor temperature;
(b) computing the deviation of shroud temperature from a steady-state shroud temperature;

(c) using the deviation of paragraph (a), computing a demanded shroud temperature; and
(d) adjusting the actual shroud temperature based on the demanded shroud temperature.

22. A method according to claim 21 in which the computing of a demanded shroud temperature comprises the step of interpolating between
(i) a demanded shroud temperature for a cold rotor and
(ii) a demanded shroud temperature for a rotor at steady-state temperature, based on the deviation of paragraph (a).

23. In a method of controlling clearance between a turbine rotor and a shroud in a gas turbine engine, the improvement comprising the step of:
(a) computing the deviation in shroud temperature from a steady-state value which corresponds to a measured deviation of rotor temperature from a steady-state value.

24. In an active clearance control for controlling clearance between a shroud and turbine blades in a gas turbine engine, the improvement comprising:
(a) a system for computing a back-up demanded shroud temperature.

25. In a system which controls clearance between turbine blades and a shroud in a gas turbine engine, the improvement comprising:
(a) a back-up system which computes demanded shroud temperature based on deviation of inferred turbine rotor temperature from a reference.

26. In an active clearance control for a turbine in a gas turbine engine, the improvement comprising:
(a) means for inferring rotor temperature from rotor speed and
(b) means for computing a demanded shroud temperature in response to the rotor temperature.

27. In an active clearance control for a turbine in a gas turbine engine, the improvement comprising:
(a) means for detecting a deviation of rotor temperature from a steady state value; and
(b) means for computing a demanded shroud temperature based on the deviation.

28. In an active clearance control for a gas turbine, the improvement comprising:
(a) means for detecting a change in rotor speed, and
(b) means for computing a demanded shroud temperature in response.

29. A control according to claim 28 and further comprising:
(c) means for modifying shroud temperature in response to demanded shroud temperature.

30. In an active clearance control for a gas turbine engine, the improvement comprising:
(a) a data base of steady-state rotor temperatures, each associated with a rotor speed;
(b) means for inferring deviation of rotor temperature from steady state temperature; and
(c) means for computing a demanded shroud temperature in response to the deviation of paragraph (b).

31. A back up system for use with an active clearance control for a turbine shroud in a gas turbine engine, comprising:
(a) a schedule which indicates shroud temperature needed under reference operating conditions;
(b) means for inferring the shroud temperature needed under non-reference conditions by extrapolating from the schedule based on deviation of the non-reference operating conditions from the reference operating condition; and
(c) means for adjusting actual shroud temperature in response to the needed shroud temperature which was inferred in paragraph (b).

32. A back-up system for use with an active clearance control for a turbine shroud in a gas turbine engine, comprising:
(a) a schedule which indicates shroud temperatures needed for respective turbine speeds under steady-state operating conditions; and
(b) means for modifying one of the scheduled shroud temperatures based on deviation of an operating condition from the steady-state conditions.

33. A control for controlling the clearance between a turbine rotor and a shroud in a gas turbine engine, comprising:
(a) temperature calculation means for providing a signal (HPRTEMP) indicative of rotor temperatures;
(b) shroud demand means for providing a signal (TCDMD) indicative of a demanded shroud temperature in response to HPRTEMP;
(c) means for bleeding air at a first, low, temperature from a compressor stage of the engine;
(d) means for bleeding air at a second temperature, higher than the first, from a different compressor stage of the engine;
(e) duct means for delivering bleed air to the shroud; and
(f) valve means for controlling the relative amounts of low temperature and high temperature air applied to the shroud.

34. A control according to claim 33 in which the temperature calculation means derives HPRTEMP from measured rotor speed.

35. A control according to claim 33 in which the temperature calculation means further comprises a model of engine performance which infers HPRTEMP from a group of measured variables, the group including rotor speed.

36. A control according to claim 33 in which the shroud demand means derives TCDMD by interpolating between
(i) a shroud temperature for a cold rotor and
(ii) a shroud temperature for a rotor at a stabilized temperature.

37. A control according to claim 33 in which the shroud demand means comprises means for interpolating between
(i) a schedule of corrected shroud temperatures for a cold rotor at different speeds; and
(ii) a schedule of corrected shroud temperatures for a rotor at a stabilized temperature, the corrected temperatures being corrected based on temperature in a selected compressor stage.

38. An apparatus according to claim 33 and further comprising:
(b) detection means for ascertaining whether the first demanded shroud temperature is correct.

39. In a primary system for controlling tip clearance of a turbine, the improvement comprising:
(a) a back-up system for use when the primary system is not operating properly, comprising:
(i) transient detection means for ascertaining whether the turbine is accelerating, decelerating, or operating at steady state;

(ii) means for computing a first demanded shroud temperature if the turbine is not at steady state; and (iii) means for computing a second demanded shroud temperature if the turbine is at steady state.

40. An apparatus according to claim 39 and further comprising:

(a) means for modifying the first and second demanded shroud temperatures during takeoff.

41. An apparatus according to claim 39 in which the back-up system further comprises:

(b) means for modifying the first demanded shroud temperature based on transient severity.

42. An apparatus according to claim 39 in which the transient back-up system further comprises:

(b) means for modifying the first demanded shroud temperature based on transient duration.

43. An apparatus according to claim 39 in which the transient detection means comprises means for ascertaining the severity of a transient.

44. In a clearance control for a turbine in a gas turbine engine, the improvement comprising a pair of back-up systems, including:

(a) a first back-up system comprising (i) detection means for detecting the occurrence of a transient and providing a transient signal in response;

(ii) means for deriving the shroud temperature needed during a transient based on both the transient signal and measured rotor temperature; and (b) a second back-up system comprising (i) means for deriving the shroud temperature needed during steady state based on measured rotor temperature.

45. A control for controlling the clearance between a turbine rotor and a shroud in a gas turbine engine, comprising:

(a) temperature calculation means for providing a signal (HPRTEMP) indicative of rotor temperatures;

(b) shroud demand means for providing a signal (TCDMD) indicative of a demanded shroud temperature in response to HPRTEMP;

(c) means for bleeding air at a first, low, temperature from a compressor stage of the engine;

(d) means for bleeding air at a second temperature higher than the first, from a different compressor stage of the engine;

(e) duct means for delivering bleed air to the shroud; and (f) valve means for controlling the relative amounts of low temperature and high temperature air applied to the shroud, and comprising:

(i) a first inlet chamber for receiving low temperature air;

(ii) a second inlet chamber for receiving higher temperature air;

(iii) an outlet chamber;

(iv) a first aperture connecting the first inlet chamber with the outlet;

(v) a second aperture connecting the second inlet chamber with the outlet;

(vi) poppet means for selectively (A) blocking both apertures;

(B) blocking the first aperture completely, while blocking the second aperture to a first predetermined degree;

(C) blocking the first aperture completely, while blocking the second aperture to a second, greater, predetermined degree;

(D) partially blocking both apertures to respective predetermined degrees;

(E) blocking the second aperture completely, while restricting the first aperture in a predetermined amount; and (F) partially blocking both apertures in amounts computed in response to TCDMD.

46. A control for controlling the clearance between a turbine rotor and a shroud in a gas turbine engine, comprising:

(a) temperature calculation means for providing a signal (HPRTEMP) indicative of rotor temperature;

(b) shroud demand means for providing a signal (TCDMD) indicative of a demanded shroud temperature in response to HPRTEMP;

(c) means for bleeding air at a first, low, temperature from a compressor stage of the engine;

(d) means for bleeding air at a second temperature, higher than the first, from a different compressor stage of the engine;

(e) duct means for delivering bleed air to the shroud;

(f) valve means for controlling the relative amounts of low temperature and high temperature air applied to the shroud; and (g) a proportional-integral-derivative controller for controlling the valve means.

47. A control for controlling the clearance between a turbine rotor and a shroud in a gas turbine engine, comprising:

(a) temperature calculation means for providing a signal (HPRTEMP) indicative of rotor temperatures;

(b) shroud demand means for providing a signal (TCDMD) indicative of a demanded shroud temperature in response to HPRTEMP;

(c) means for bleeding air at a first, low, temperature from a compressor stage of the engine;

(d) means for bleeding air at a second temperature, higher than the first, from a different compressor stage of the engine;

(e) duct means for delivering bleed air to the shroud;

(f) valve means for controlling the relative amounts of low temperature and high temperature air applied to the shroud; and (g) a control system for controlling the valve, in which the gain varies approximately as follows:

(i) for frequencies below a first frequency, the gain decreases with increasing frequency;

(ii) for frequencies between the first frequency and a second frequency, the gain remains substantially constant; and (iii) for frequencies above the second frequency, the gain increase with increasing frequency.

* * * * *